US006503413B2

(12) United States Patent
Uchiyama et al.

(10) Patent No.: US 6,503,413 B2
(45) Date of Patent: Jan. 7, 2003

(54) STABLE, AQUEOUS COMPOSITIONS FOR TREATING SURFACES, ESPECIALLY FABRICS

(75) Inventors: Hirotaka Uchiyama, Symmes Twp, OH (US); Janese Christine O'Brien Stickney, Wyoming, OH (US); Jonathan Robert Cetti, Fairfield, OH (US); Ricky Ah-Man Woo, Hamilton, OH (US); Dean Larry DuVal, Lebanon, OH (US); Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/783,509

(22) Filed: Feb. 14, 2001

(65) Prior Publication Data

US 2002/0011584 A1 Jan. 31, 2002

Related U.S. Application Data

(63) Continuation-in-part of application No. 09/634,379, filed on Aug. 9, 2000.

(60) Provisional application No. 60/240,626, filed on Oct. 16, 2000, and provisional application No. 60/182,381, filed on Feb. 14, 2000.

(51) Int. Cl.[7] ..... D06M 15/643

(52) U.S. Cl. ..... 252/8.91; 252/8.61; 424/76.1; 424/76.2

(58) Field of Search ..... 252/8.61, 8.91; 424/76.1, 76.2

(56) References Cited

U.S. PATENT DOCUMENTS

| | | | | | |
|---|---|---|---|---|---|
| 3,299,112 | A | * | 1/1967 | Bailey | 516/199 |
| 3,359,212 | A | | 12/1967 | Bailey | |
| 3,526,651 | A | * | 9/1970 | Rossmy et al. | 556/446 |
| 4,005,024 | A | | 1/1977 | Rodriguez et al. | |
| 4,661,268 | A | | 4/1987 | Jacobson et al. | |
| 5,482,703 | A | * | 1/1996 | Pings | 424/70.12 |
| 5,500,254 | A | | 3/1996 | Quincy, III et al. | |
| 5,525,415 | A | | 6/1996 | Quincy, III et al. | |
| 5,540,984 | A | | 7/1996 | Quincy, III et al. | |
| 5,654,262 | A | * | 8/1997 | Desai et al. | 510/112 |
| 5,741,760 | A | * | 4/1998 | Mondin et al. | 510/101 |
| 5,804,625 | A | | 9/1998 | Temperante | |
| 5,858,335 | A | * | 1/1999 | Lucas et al. | 422/5 |
| 5,861,147 | A | * | 1/1999 | Dodd et al. | 422/5 |
| 5,942,217 | A | | 8/1999 | Woo et al. | |
| 5,955,093 | A | | 9/1999 | Woo et al. | |
| 5,968,404 | A | | 10/1999 | Trinh et al. | |
| 5,968,990 | A | | 10/1999 | Jon et al. | |
| 5,997,759 | A | | 12/1999 | Trinh et al. | |
| 6,001,343 | A | | 12/1999 | Trinh et al. | |
| 6,033,679 | A | | 3/2000 | Woo et al. | |
| 6,077,317 | A | | 6/2000 | Murphy | |
| 6,100,233 | A | | 8/2000 | Sivik et al. | |
| 6,106,738 | A | * | 8/2000 | Woo et al. | 106/205.01 |
| 6,284,231 | B1 | * | 9/2001 | Trinh et al. | 424/76.1 |

FOREIGN PATENT DOCUMENTS

| | | |
|---|---|---|
| GB | 805768 | 12/1958 |
| JP | 7109486 | 4/1995 |
| WO | WO 9807455 A1 | 2/1998 |
| WO | WO 9856429 A1 | 12/1998 |
| WO | WO 9856888 A1 | 12/1998 |
| WO | WO 9856890 A1 | 12/1998 |
| WO | WO 9910767 A1 | 3/1999 |
| WO | WO 9933669 A1 | 7/1999 |
| WO | WO 9955814 A1 | 11/1999 |
| WO | WO 9955815 A1 | 11/1999 |
| WO | WO 9955948 A1 | 11/1999 |
| WO | WO 9955949 A1 | 11/1999 |
| WO | WO 9955950 A1 | 11/1999 |
| WO | WO 9955951 A1 | 11/1999 |
| WO | WO 9955952 A1 | 11/1999 |
| WO | WO 9955953 A1 | 11/1999 |
| WO | WO 0008249 A1 | 2/2000 |
| WO | WO 0024851 A2 | 5/2000 |
| WO | WO 0024856 A1 | 5/2000 |
| WO | WO 0024858 A1 | 5/2000 |
| WO | WO 0030691 A1 | 6/2000 |
| WO | WO 0055292 A1 | 9/2000 |

* cited by examiner

*Primary Examiner*—Anthony J. Green
(74) *Attorney, Agent, or Firm*—Jeffrey V. Bamber; Jason J. Camp

(57) ABSTRACT

Stable, aqueous compositions for treating surfaces, especially fabrics, comprise: a relatively low molecular weight polyalkyleneoxide polysiloxane surfactant; a buffering agent to maintain the pH of the composition in the range of from about 4 to about 10, preferably from about 5 to about 9.5, and more preferably from about 6 to about 9; and an aqueous carrier. The compositions can further comprise catoinic surfactants to further enhance the spreading and/or fabric penetration ability of the compositions. The compositions can further comprise a variety of other optional ingredients. Methods of treating surfaces include methods wherein the compositions are contacted with surfaces, especially fabrics, to reduce malodor impression on the surfaces and/or reduce the appearance of wrinkles in fabrics.

29 Claims, No Drawings

STABLE, AQUEOUS COMPOSITIONS FOR TREATING SURFACES, ESPECIALLY FABRICS

CROSS-REFERENCE TO RELATED APPLICATIONS

This patent application claims the benefit of U.S. Provisional Application Ser. No. 60/240,626 filed Oct. 16, 2000 by Uchiyama et al.; and is a continuation-in-part of U.S. patent application Ser. No. 09/634,379 filed Aug. 9, 2000 by Frankenbach et al., which claims the benefit of U.S. Provisional Application Ser. No. 60/182,381 filed Feb. 14, 2000 by Frankenbach et al.

TECHNICAL FIELD

The present invention relates to stable, aqueous compositions for treating surfaces, especially fabrics, comprising polyalkyleneoxide polysiloxanes. The present invention further relates to methods of using the compositions for reducing malodor impression on surfaces, especially fabrics, and/or reducing the appearance of wrinkles on fabrics. The present invention further relates to articles of manufacture for treating surfaces, especially fabrics, comprising a spray dispenser containing the stable, aqueous composition.

BACKGROUND OF THE INVENTION

Polyalkyleneoxide polysiloxanes have been incorporated in compositions, such as herbicide compositions, to enhance the ability of compositions to distribute (i.e. spread) across a surface. Certain polyalkyleneoxide polysiloxanes, especially those having a relatively low molecular weight, have been referred to as "superwetting" agents due to their ability to significantly enhance the ability of a composition to distribute across a surface. However, such polyalkyleneoxide polysiloxane materials tend to be rather unstable in aqueous solutions, especially over relatively long periods of time.

For example, U.S. Pat. No. 5,968,990 issued Oct. 19, 1999 to Jon et al. discloses a water-dilutable, microemulsion concentrate and pour-on formulations for water-insoluble insecticides such as amitraz. In Example 14 of Jon et al., 2% of Silwet L-77® (a low molecular weight polyalkyleneoxide polysiloxane) was added to Example 13 of Jon et al. to enhance spreading and wetting of the microemulsion of Example 13. The composition was then diluted with hard water. It is noted by Jon et al. that the diluted composition was slightly hazy and the polysiloxane material settled out of solution after 1 day at room temperature.

It has thus been desired to develop a composition for treating surfaces, especially fabrics, that has enhanced ability to distribute across the surface of the fabrics and penetrate in between the fibers of fabrics. It has further been desired to develop such a composition that is stable over a relatively long period of time.

SUMMARY OF THE INVENTION

The present invention encompasses stable, aqueous compositions for treating surfaces, especially fabrics, preferably for reducing malodor impression on surfaces and/or reducing the appearance of wrinkles in fabrics, the compositions comprising:

(a) a polyalkyleneoxide polysiloxane having the formula:

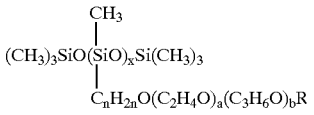

$$(CH_3)_3SiO(\overset{\overset{CH_3}{|}}{\underset{\underset{C_nH_{2n}O(C_2H_4O)_a(C_3H_6O)_bR}{|}}{Si}}O)_xSi(CH_3)_3$$

wherein x is from about 1 to about 8; n is from about 3 to about 4; a is from about 1 to about 15; b is from about 0 to about 14; a+b is from about 5 to about 15; and R is selected from the group consisting of hydrogen, an alkyl group having from about 1 to about 4 carbon atoms, and an acetyl group; and wherein said polyalkylene polysiloxane has a molecular weight of less than about 1,000;

(b) a buffering agent; wherein said buffering agent has at least one $pK_a$ value and/or $pK_b$ value of from about 4 to about 10; and (c) aqueous carrier;

wherein said composition has a pH of from about 4 to about 10. The compositions preferably further comprise a cationic surfactant to further enhance the spreading and/or fabric penetration ability of the compositions. The compositions can be dilute or concentrated aqueous compositions. The compositions can further comprise a variety of other optional ingredients and are preferably essentially free of materials that would soil or stain fabrics under usage conditions.

The present invention also relates to methods of treating surfaces, especially fabrics, with the compositions of the present invention. The methods more specifically relate to reducing malodor impression on surfaces and/or reducing the appearance of wrinkles on fabrics.

The present invention further relates to articles of manufacture comprising the compositions of the present invention packaged in a spray dispener (preferably with dilute compositions) or a bottle having a measuring closure (preferably with concentrated compositions). The articles preferably further comprise a set of instructions to instruct a consumer to carry out the methods of the present invention.

DETAILED DESCRIPTION OF THE INVENTION

I. COMPOSITIONS

The present invention relates to stable, aqueous compositions for treating surfaces, especially fabrics. The compositions herein are particularly suitable for reducing malodor impression on surfaces having malodor impression, and/or for reducing the appearance of wrinkles in fabrics.

The stable, aqueous compositions herein comprise: a relatively low molecular weight polyalkyleneoxide polysiloxane surfactant; a buffering agent to maintain the pH of the composition in the range of from about 4 to about 10, preferably from about 5 to about 9.5, and more preferably from about 6 to about 9; and an aqueous carrier.

The stable, aqueous compositions of the present invention preferably further comprise a cationic surfactant. Cationic surfactants incorporated in the present compositions tend to further enhance the ability of the compositions to distribute (or spread) across the treated surface. In addition, where the treated surface is fabric, the cationic surfactant enhances the ability of the composition to penetrate in between the fibers of the fabric and also can enhance the softness of the treated fabric. It is thus highly desirable to incorporate the optional cationic surfactants in the compositions of the present invention.

The stable, aqueous compositions herein include dilute compositions that can be conveniently distributed to a surface, especially fabrics, via a spray dispenser. The compositions herein further relate to concentrated compositions that can be diluted with water to form dilute compositions, or can be concentrated compositions suitable for adding, for example, to a wash and/or rinse cycle in a typical laundry process. The compositions herein provide reduction of malodor impression on surfaces (especially fabrics) and/or reduction of the appearance of wrinkles in fabrics.

Preferably, the stable, aqueous compositions of the present invention are clear. The term "clear" as defined herein means transparent or translucent, preferably transparent, as in "water clear," when observed through a layer having a thickness of less than about 10 cm.

The present stable, aqueous compositions are preferably essentially free of, or free of, any material that would soil or stain fabric under usage conditions, or at least do not contain such materials at a level that would soil or stain fabrics unacceptably under usage conditions.

The compositions herein are also preferably essentially free of, or free of, herbicide active materials.

A. POLYALKYLENEOXIDE POLYSILOXANE SURFACTANTS

As mentioned hereinbefore, polyalkyleneoxide polysiloxane compounds, especially those having a molecular weight of less than about 1,000, greatly enhance the ability of a composition to distribute (or spread) across a surface treated with the composition. Also, it has been found that such compounds, when used in compositions for treating fabrics, greatly enhance the ability of the composition to penetrate in between fibers of fabrics. However, such polyalkyleneoxide polysiloxane surfactants can be rather unstable in aqueous compositions. It has been found that the pH of the present compositions needs to be carefully controlled and thus the present compositions require a suitable buffering agent to stabilize these compositions comprising relatively low molecular weight polyalkyleneoxide polysiloxane surfactants.

The polyalkyleneoxide polysiloxane surfactants suitable in the stable, aqueous compositions of the present invention have the general formula:

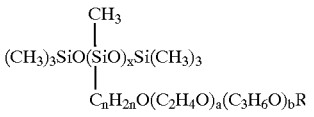

wherein x has a value of from about 1 to about 8; preferably from about 1 to 3; and more preferably 1;

n has a value of from about 3 to about 4, preferably n is about 3;

a has a value of from about I to about 15, preferably a is from about 6 to about 10;

b has a value of from about 0 to about 14, preferably b Is from about 0 to about 3:

and most preferably b is about 0, a+b has a value of from about 5 to about 15, preferably from about 6 to about 10 and R is selected from the group consisting of hydrogen, an alkyl group having from about 1 to about 4 carbon atoms, and an acetyl group.

The molecular weight of the polyalkyleneoxide polysiloxane surfactants herein is less than about 1000, preferably less than about 800, and more preferably less than about 700. Thus, the values of a and b can be those numbers which provide molecular weights within these ranges. However, the number of oxyethylene units (—$C_2H_4O$) in the polyether chain must be sufficient to render the polyalkyleneoxide polysiloxane water dispersible or water soluble. It is understood that when b is a positive number, the oxyethylene (—$C_2H_4O$) and oxypropylene units (—$C_3H_6O$) may be distributed randomly throughout the polysiloxane chain or in respective blocks of oxyethylene and oxypropylene units or a combination of random and block distributions.

The preparation of polyalkyleneoxide polysiloxanes is well known in the art. Polyalkyleneoxide polysiloxanes of the present invention may be prepared according the procedure set forth in U.S. Pat. No. 3,299,112, which is incorporated herein by reference. Typically, polyalkyleneoxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at temperature of from about 85° C. to 110° C.) in the presence of a platinum catalyst (e.g., chloroplatinic acid) and a solvent (e.g., toluene).

Examples of suitable polyalkyleneoxide polysiloxane surfactants herein are commercially available under the trade names Silwet L-77®, Silwet® L-7280, and Silwet® L-7608 available from CK Witco Corporation; and DC Q2-5211 and Sylgard™ 309 available from Dow Coming Corporation.

The polyalkylene oxide polysiloxane surfactants herein are typically incorporated in the present, stable dilute aqueous compositions at the level of from about 0.0001% to about 10%, preferably from about 0.001% to about 7%, and more preferably from about 0.01% to about 5%, by weight of the composition. In the stable, concentrate aqueous compositions, polyalkylene oxide polysiloxane surfactants are typically incorporated at the level of from about 0.001% to about 70%, preferably from about 0.01% to about 60%, and more preferably from about 0. % to about 50%, by weight of the composition.

B. BUFFERING AGENTS

As discussed herein, the aqueous compositions comprising the low molecular weight polyalkyleneoxide polysiloxane surfactants herein tend to be rather unstable, especially if the pH of the compositions is not carefully controlled. The pH of the present compositions is controlled within the ranges of from about 4 to about 10, preferably from about 5 to about 9.5, and more preferably from about 6 to about 9. In order to sustain the pH of the present aqueous compositions over a relatively long period of time, a buffering agent is employed in the present compositions that comprise the low molecular weight polyalkyleneoxide polysiloxane surfactants herein.

The buffering agent can be an organic or inorganic acid or base, and alkali metal salts thereof, having at least one $pK_a$ value and/or $pK_b$ value of from about 4 to about 10, preferably from about 5 to about 9.5, and more preferably from about 6 to about 9. Preferably, the buffering agent is an alkali metal salt of an organic acid and/or inorganic acid having at least one $pK_a$ value of from about 6 to about 9. It shall be recognized that buffering agents may have more than one $pK_a$ value and/or $pK_b$ value. A buffering agent can be suitable herein so long as at least one of its $pK_a$ values and/or $pK_b$ values falls within the indicated ranges.

Suitable buffering agents herein include those selected from the group consisting of acridine, phenylalanine, allothreonine, n-amylamine, aniline, n-allylaniline, 4-bromoaniline, 4-bromo-N,N-dimethylaniline, m-chloroaniline, p-chloroaniline, 3-chloro-N,N-dimethylaniline, 3,5-dibromoaniline, N,N-diethylaniline, N,N-dimethylaniline, N-ethylaniline, 4-fluoroaniline, N-methylaniline, 4-methylthioaniline, 3-sulfonic acid aniline, 4-sulfonic acid aniline, p-anisidine, arginine, asparagine, glycyl asparagine, DL-aspartic acid, aziridine, 2-aminoethylbenzene, benzidine, benzimidazole, 2-ethylbenzimidazole, 2-methylbenzimidazole, 2-phenylbenzimidazole, 2-aminobenzoic acid, 4-aminobenzoic acid, benzylamine, 2-aminobiphenyl, brucine, 1,4-diaminobutane, t-butylamine 4-aminobutyric acid, glycyl-2-amino-n-butyric acid, cacodylic acid, β-chlortriethylammonium-n-butyric acid, codeine, cyclohexylamine, cystine, n-decylamine, diethylamine, n-dodecaneamine, 1-ephedrine, 1-amino-3-methoxyethane, 1,2-bismethylaminoethane, 2-aminoethanol, ethylenediamine, ethylenediaminetetraacetic acid, 1-glutamic acid, α-monoethylglutamic acid, 1-glutamine, 1-glutathione, glycine, n-acetylglycine, dimethylglycine, glycylglycylglycine, leucylglycine, methylglycine, phenylglycine, N-n-propylglycine, tetraglycylglycine, glycylserine, dexadecaneamine, 1-aminoheptane, 2-aminoheptane, 2-aminohexanoic acid, DL-histidine, β-alanylhistidine, imidazol, 1-aminoindane, 2-aminoisobutyric acid, isoquinoline, 1-aminoisoquinoline, 7-hydroxyisoquinoline, 1-leucine, glycylleucine, methionine, methylamine, morphine, morpholine, 1-amino-6-hydroxynaphthalene, dimethylaminonaphthalene, α-naphthylamine, β-naphthylamine, n-methyl-α-naphthylamine, cis-neobornylamine, nicotine, n-nonylamine, octadecaneamine, octylamine, ornithine, papaverine, 3-aminopentane, valeric acid, permidine, phenanthridine, 1,10-phenanthroline, 2-ethoxyaniline, 3-ethoxyaniline, 4-ethoxyaniline, α-picoline, β-picoline, γ-picoline, pilocarpine, piperazine, trans-2,5-dimethylpiperazine, 1-n-butylpiperidine, 1,2-dimethylpiperidine, 1-ethylpiperidine, 1-methylpiperidine, proline, hydroxyproline, 1-amino-2,2-dimethylpropane, 1,2-diaminopropane, 1,3-diaminopropane, 1,2,3-triaminopropane, 3-aminopropanoic acid, pteridine, 2-amino-4,6-dihydroxypteridine, 2-amino-4-hydroxypteridine, 6-chloropteridine, 6-hydroxy-4-methylpteridine, purine, 6-aminopurine, 2-dimethylaminopurine, 8-hydroxypurine, 2-methylpyrazine, 2-amino-4,6-dimethylpyrimidine, pyridine, 2-aldoximepyridine, 2-aminopyridine, 4-aminopyridine, 2-benzylpyridine, 2,5-diaminopyridine, 2,3-dimethylpyridine, 2,4-dimethylpyridine, 3,5-dimethylpyridine, 2-ethylpyridine, methyoxypyridine, 4-methylaminopyridine, 2,4,6-trimethylpyridine, 1,2-dimethylpyrrolidine, n-methylpyrrolidine, 5-hydroxyquinazoline, quinine, 3-quinolinol, 8-quinolinol, 8-hydroxy-5-sulfoquinoline, 6-methoxyquinoline, 2-methylquinoline, 4-methylquinoline, 5-methylquinoline, serine, strychnine, taurine, myristilamine, 2-aminothiazole, threonine, o-toluidine, m-toluidine, p-toluidine, 2,4,6-triamino-1,2,3-triazine, tridecaneamine, trimethylamine, tryptophan, tyrosine, tyrosineamide, valine, and mixtures thereof.

Other suitable buffering agents include those selected from the group consisting of acetic acid, acetoacetic acid, acrylic acid, adipamic acid, adipic acid, d-alinine, allantoin acid, alloxanic acid, α-aminoacetic acid, o-aminobenzoic acid, p-aminobenzoic acid, m-aminobenzosulfonic acid, p-aminobenzosulfonic acid, anisic acid, o-β-anisylpropionic acid, m-β-propionic acid, p-β-propionic acid, ascorbic acid, DL-aspartic acid, barbituric acid, benzoic acid, m-bromobenzoic acid, n-butyric acid, iso-butyric acid, cacodylic acid, n-caproic acid, iso-caproic acid, m-chlorobenzoic acid, p-chlorobenzoic acid, β-chlorobutyric acid, γ-chlorobutyric acid, o-chlorocinnamic acid, m-chlorocinnamic acid, p-chlorocinnamic acid, o-chlorophenylacetic acid, m-chlorophenylacetic acid, p-chlorophenylacetic acid, β-(o-chlorophenyl)propionic acid, β-(m-chlorophenyl)propionic acid, β-(p-chlorophenyl)propionic acid, β-chloropropionic acid, cis-cinnamic acid, trans-cirinamic acid, citric acid, o-cresol, m-cresol, p-cresol, trans-crotonic acid, cyclohexane-1:1-dicarboxylic acid, cyclopropane-1:1-dicarboxylic acid, DL-cysteine, L-cysteine, deuteroacetic acid, 2,3-dichlorophenol, 3,4-dihydroxybenzoic acid, 3,5-dihydroxybenzoic acid, dimethylglycine, dimethylmalic acid, 2,4-dintirophenol, 3,6-dinitrophenol, diphenylacetic acid, ethylbenzoic acid, formic acid, trans-fumaric acid, gallic acid, glutaramic acid, glutaric acid, glycine, glycolic acid, heptanoic acid, hexahydrobenzoic acid, hexanoic acid, hippuric acid, histidine, hydroquinone, m-hydroxybenzoic acid, p-hyroxybenzoic acid, β-hyroxybutyric acid, γ-hydroxybutyric acid, β-hydroxypropionic acid, γ-hydroxyquinoline, iodoacetic acid, m-iodobenzoic acid, itaconic acid, lysine, maleic acid, malic acid, malonic acid, DL-mandelic acid, mesaconic acid, mesitylenic acid, methyl-o-aminobenzoic acid, methyl-m-aminobenzoic acid, methyl-p-aminobenzoic acid, o-methylcinnamic acid, m-methylcinnamic acid, p-methylcinnamic acid, β-methylglutaric acid, n-methylglycine, methylsuccinic acid, o-monochlorophenol, m-monochlorophenol, p-monochlorophenol, α-naphthoic acid, β-naphthoic acid, α-naphthol, β-naphthol, nitrobenzene, m-nitrobenzoic acid, p-nitrobenzoic acid, o-nitrophenol, m-nitrophenol, p-nitrophenol, o-nitrophenylacetic acid, m-nitrophenylacetic acid, p-nitrophenylacetic acid, o-β-nitrophenylpropionic acid, m-β-nitrophenylpropionic acid, p-β-nitrophenylpropionic acid, nonanic acid, octanoic acid, oxalic acid, phenol, phenylacetic acid, o-phenylbenzoic acid, γ-phenylbutyric acid, α-phenylpropionic acid, β-phenylpropionic acid, o-phthalic, m-phthalic, p-phthalic, pimelic acid, propionic acid, iso-propylbenzoic acid, 2-pyridinecarboxylic acid, 3-pyridinecarboxylic acid, 4-pyridinecarboxylic acid, pyrocatecchol, resorcinol, saccharin, suberic acid, succinic acid, α-tartaric acid, meso-tartaric acid, theobromine, terephthalic acid, thioacetic acid, thiophenecarboxylic acid, o-toluic acid, m-toluic acid, p-toluic acid, trichlorophenol, trimethylacetic acid, tryptophan, tyrosine, uric acid, n-valeric, iso-valeric, veronal acid, vinylacetic acid, xanthine, and mixtures thereof.

Further suitable buffering agents include those selected from the group consisting of arsenic acid, arsenious acid, o-boric acid, carbonic acid, chromic acid, germanic acid, hyrocyanic acid, hydrofluoric acid, hydrogen sulfide, hypobromous acid, nitrous acid, o-phosphoric acid, phosphorous acid, pyrophosphoric acid, selenious acid, m-silicic acid, o-silicic acid, sulfurous acid, telluric acid, tellureous acid, tetraboric acid, and mixtures thereof.

Buffering agents in the present compositions are preferably selected from the group consisting of 3-chloropropanoic acid, citric acid, ethylenedinitrilotetraacetic acid (i.e. "EDTA"), alanine, aminobenzene, sulfanilic acid, 2-aminobenzoic acid, 2-aminophenol, ammonia, arginine, asparagine, aspartic acid, dimethyleneimine, benzene-1,2,3-tricarboxylic acid, benzoic acid, benzylamine, 2,2-bipyridine, butanoic acid, maleic acid, carbonic acid, dichloroacetic acid, diethylamine, catechol, resorcinol, d-tartaric acid, ethylenediamine, glutamic acid, glutamine, glycine, adipic acid, hydrogen hypophosphite, isoleucine, leucine, methionine, 3-nitrobenzoic acid, 4-nitrobenzoic acid, phthalic acid, iodoacetic acid, histidine, lysine, 4-methylaniline, o-cresol, 2-naphthoic acid, nitrilotriacetic acid, 2-nitrobenzoic acid, 4-nitrophenol, 2,4-dinitrophenol, N-nitrosophenylhydroxylamine, nitrous acid, phosphoric acid, phenylalanine, piperdine, serine, hydrogen sulfite, threonine, tris(hydroxymethyl)aminomethane (i.e. "TRIS" or "THAM"), tyrosine; alkali metal salts thereof; and mixtures thereof. Most preferred are alkali metal salts of citric acid, such as sodium citrate dihydrate.

The buffering agents herein are typically incorporated in the present dilute compositions at a level from about 0.0001% about 10%, preferably from about 0.001% to about 7%, and more preferably from about 0.01% to about 5% by weight of the composition. In the concentrate aqueous compositions, buffering agents are typically incorporated at the level of from about 0.001% to about 70%, preferably from about 0.01% to about 60%, and more preferably from about 0.1% to about 50%, by weight of the composition.

C. CATIONIC SURFACTANTS

The present compositions optionally, but highly preferably, further comprise a cationic surfactant. The addition of cationic surfactants to the present compositions, in combination with polyalkyleneoxide polysiloxane surfactants as described hereinbefore, can further increase the ability of the composition to spread across surfaces, such as fabrics. Such cationic surfactants also improve the ability of the present compositions to penetrate in between the fibers of fabrics. As a result, the compositions exhibit better performance, in terms of reducing malodor impression on fabric and/or reducing the appearance of wrinkles on fabrics.

Cationic surfactants useful herein are preferably selected from the group consisting of quaternary ammonium compounds (including diester quaternary ammonium compounds), biguanide compounds, and mixtures thereof.

When cationic surfactants are incorporated in the present, dilute compositions, they are included at levels from about 0.0001% to about 10%, preferably from about 0.001% to about 7%, and more preferably from about 0.01% to about 5% by weight of the composition. When included in concentrate aqueous compositions, cationic surfactants are typically incorporated at the level of from about 0.001% to about 70%, preferably from about 0.01% to about 60%, and more preferably from about 0.1% to about 50%, by weight of the composition.

If the present compositions comprise the optional cationic surfactant and further comprise the optional cyclodextrin odor control agent, as described hereinafter, it is preferable that the compositions further comprise an additional co-surfactant that is cyclodextrin-compatible. Cationic surfactants tend to complex with cyclodextrins, thus reducing the odor controlling ability of the cyclodextrin. By incorporating an additional co-surfactant that is cyclodextrin-compatible, the co-surfactant tends to keep the cationic surfactant and cyclodextrin from complexing with each other.

1. Quaternary Compounds

A wide range of quaternary compounds can be used as cationic surfactants herein, in conjunction with the polyalkyleneoxide polysiloxane surfactants. Many quaternary compounds also exhibit antimicrobial effectiveness, depending on the level utilized in the compositions. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$–$C_{14}$)alkyl di short chain ($C_{1-4}$ alkyl and/or hydroxyalkl) quaternary such as Bardac® products of Lonza, (3) N-(3-chloroallyl) hexaminium chlorides such as Dowicide® and Dowicil® available from Dow; (4) benzethonium chloride such as Hyamine® from Rohm & Haas; (5) methylbenzethonium chloride represented by Hyamine® 10×supplied by Rohm & Haas, (6) cetylpyridinium chloride such as Cepacol chloride available from of Merrell Labs. Examples of the preferred dialkyl quaternary compounds are di($C_8$–$C_{12}$)dialkyl dimethyl ammonium chloride, such as didecyldimethylammonium chloride (Bardac 22), and dioctyidimethylammonium chloride (Bardac 2050). The quaternary compounds useful as cationic antimicrobial actives herein are preferably selected from the group consisting of dialkyldimethylammonium chlorides, alkyldimethylbenzylammonium chlorides, dialkylmethylbenzylammonium chlorides, and mixtures thereof. Other preferred cationic antimicrobial actives useful herein include diisobutylphenoxyethoxyethyl dimethylbenzylammonium chloride (commercially available under the trade name Hyamine® 1622 from Rohm & Haas) and (methyl) diisobutylphenoxyethoxyethyl dimethylbenzylammonium chloride (i.e. methylbenzethonium chloride). Typical concentrations in dilute compositions for increasing the spreading and fabric penetration ability of these quaternary compounds, especially in the preferred low-surfactant compositions herein, range from about 0.0001% to about 10%, preferably from about 0.001% to about 7%, more preferably from about 0.005% to about 6% and even more preferably from about 0.01% to about 5%. Typical concentrations in concentrate compositions range from about 0.001% to about 70%, preferably from about 0.01% to about 65%, more preferably from about 0.05% to about 60%, and even more preferably from about 0.1% to about 50%, by weight of the composition.

Other cationic surfactants useful herein are diester quaternary ammonium compounds ("DEQA"). DEQA compounds not only improve the spreading ability of the present compositions, but can also enhance the softness of fabrics that are treated with the present compositions. The first type of DEQA preferably comprises, as the principal active, [DEQA (I)] compounds of the formula:

$$\{R_{4-m}—N^+—[(CH_2)_n—Y—R^1]m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $X^-$ can be any compatible anion, preferably, chloride, bromide, methylsulfate, ethylsulfate, sulfate, and nitrate, more preferably chloride or methyl sulfate (As used herein, the "percent of cationic surfactant" containing a given $R^1$ group is based upon taking a percentage of the total cationic surfactant based upon the percentage that the given $R^1$ group is, of the total $R^1$ groups present.);

(2) A second type of DEQA active [DEQA (2)] has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)}$$

wherein each R is a methyl or ethyl group and preferably each $R^1$ is in the range of $C_{15}$ to $C_{25}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium compound having the formula 1,2-di(acyloxy)-3-trimethylammoniopropane chloride, where the acyl is the same as that of $FA^1$ disclosed hereinafter.

Other useful quaternary compounds in the present compositions are those having the formula:

$$[R^1C(O)OC_2H_4]_mN^+(R)_{4-m}X^-$$

wherein each $R^1$ in a compound is a $C_6$–$C_{22}$ hydrocarbyl group, preferably having an Iodine Value ("IV") from about 70 to about 140 based upon the IV of the equivalent fatty acid with the cis/trans ratio preferably being as described hereinafter, m is a number from I to 3 on the weight average in any mixture of compounds, each R in a compound is a $C_{1-3}$ alkyl or hydroxy alkyl group, the total of m and the number of R groups that are hydroxyethyl groups equaling 3, and X is a compatible anion, preferably methyl sulfate. Preferably the cis:trans isomer ratio of the fatty acid (of the C18:1 component) is at least about 1:1, preferably about 2:1, more preferably about 3:1, and even more preferably about 4:1, or higher.

Preferred cationic surfactants, preferably biodegradable quaternary ammonium compounds can contain the group —(O)$CR^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups.

As used herein, when the DEQA diester (m=2) is specified, it can include the monoester (m=1) and/or triester (m=3) that are present. Preferably, at least about 30% of the DEQA is in the diester form, and from 0% to about 30% can be DEQA monoester, e.g., there are three R groups and one $R^1$ group. The overall ratios of diester "quaternary ammonium active" (quat) to monoester quat are typically from about 2.5:1 to about 1:1, preferably from about 2.3:1 to about 1.3:1. The level of monoester present can be controlled in manufacturing the DEQA by varying the ratio of fatty acid, or fatty acyl source, to triethanolamine. The overall ratios of diester quat to triesterquat are from about 10:1 to about 1.5:1, preferably from about 5:1 to about 2.8:1.

The above compounds can be prepared using standard reaction chemistry. In one synthesis of a di-ester variation of DTDMAC, triethanolamine of the formula $N(CH_2CH_2OH)_3$ is esterified, preferably at two hydroxyl groups, with an acid chloride of the formula $R^1C(O)Cl$, to form an amine which can be made cationic by acidification (one R is H) to be one type of compound, or then quatemized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

In preferred DEQA (1) and DEQA (2) quaternary compounds, each $R^1$ is a hydrocarbyl, or substituted hydrocarbyl, group, preferably, alkyl, monounsaturated alkenyl, and polyunsaturated alkenyl groups, with the quaternary compound containing polyunsaturated alkenyl groups being preferably at least about 3%, more preferably at least about 5%, more preferably at least about 10%, and even more preferably at least about 15%, by weight of the total quaternary compound present; the quaternary compounds preferably containing mixtures of $R^1$ groups, especially within the individual molecules.

The DEQAs herein can also contain a low level of fatty acid, which can be from unreacted starting material used to form the DEQA and/or as a by-product of any partial degradation (hydrolysis) of the quaternary compound in the finished composition. It is preferred that the level of free fatty acid be low, preferably below about 15%, more preferably below about 10%, and even more preferably below about 5%, by weight of the quaternary compound.

The quaternary compounds herein are preferably prepared by a process wherein a chelant, preferably a diethylenetriaminepentaacetate (DTPA) and/or an ethylene diamine-N, N'-disuccinate (EDDS) is added to the process. Another acceptable chelant is tetrakis-(2-hydroxylpropyl) ethylenediamine (TPED). Also, preferably, antioxidants are added to the fatty acid immediately after distillation and/or fractionation and/or during the esterification reactions and/or post-added to the finished quaternary compound. The resulting quaternary compound has reduced discoloration and malodor associated therewith.

The total amount of added chelating agent is preferably within the range of from about 10 ppm to about 5,000 ppm, more preferably within the range of from about 100 ppm to about 2500 ppm by weight of the formed quaternary compound. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of the steps in the processing of the triglyceride up to, and including, the formation of the quaternary compound.

The above processes produce quaternary compounds with reduced coloration and malodor.

Other Quaternary Compounds

The compositions can also contain other, usually supplementary, quaternary compound(s), usually in minor amounts, typically from 0% to about 35%, preferably from about 1% to about 20%, more preferably from about 2% to about 10%, said other quaternary compounds being selected from:

(1) compounds having the formula:

$$[R_{4-m}—N^{(+)}—R^1_m]A^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a compatible anion, preferably, chloride, bromide, methylsulfate, ethylsulfate, sulfate, and nitrate, more preferably chloride and methyl sulfate;

(2) compounds having the formula:

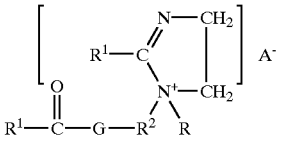

wherein each R, $R^1$, and $A^-$ have the definitions given above; each $R^2$ is a $C_{1-6}$ alkylene group, preferably an ethylene group; and G is an oxygen atom or an —NR— group;

(3) compounds having the formula:

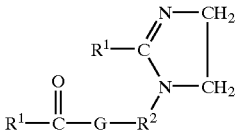

wherein $R^1$, $R^2$ and G are defined as above;

(4) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group;

(5) compounds having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above;

(7) compounds having the formula:

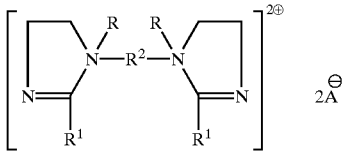

wherein R, $R^1$, $R^2$, and $A^-$ are defined as above; and mixtures thereof.

Other optional but highly desirable cationic surfactants which can be used in combination with the above quaternary compounds are compounds containing one long chain acyclic $C_8$–$C_{22}$ hydrocarbon group, selected from the group consisting of:

(8) acyclic quaternary ammonium salts having the formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(9) substituted imidazolinium salts having the formula:

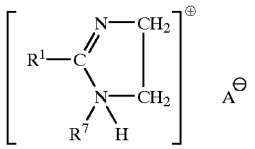

wherein $R^7$ is hydrogen or a $C_1$–$C_4$ saturated alkyl or hydroxyalkyl group, and $R^1$ and $A^-$ are defined as hereinabove;

(10) substituted imidazolinium salts having the formula:

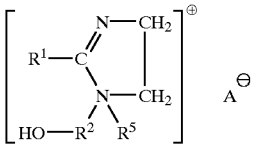

wherein $R^5$ is a $C_1$–$C_4$ alkyl or hydroxyalkyl group, and $R^1$, $R^2$, and $A^-$ are as defined above;

(11) alkylpyridinium salts having the formula:

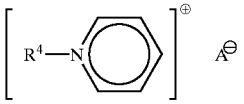

wherein $R^4$ is an acyclic aliphatic $C_8$–$C_{22}$ hydrocarbon group and $A^-$ is an anion; and

(12) alkanamide alkylene pyridinium salts having the formula:

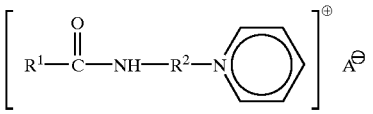

wherein $R^1$, $R^2$ and $A^-$ are defined as herein above; and mixtures thereof.

Examples of Compound (8) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (8) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl) oleylammonium chloride wherein $R^1$ is a $C_{18}$ hydrocarbon group, $R^5$ is a 2-hydroxyethyl group and $R^6$ is a methyl group.

Additional quaternary compounds that can be used herein are disclosed, at least generically for the basic structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference. The additional quaternary compounds herein are preferably those that are highly unsaturated versions of the traditional quaternary compounds, i.e., di-long chain alkyl nitrogen derivatives, normally cationic materials, such as dioleyldimethylammonium chloride and imidazolinium compounds as described hereinafter. Examples of more biodegradable quaternary compounds can be found in U.S. Pat. No. 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and U.S. Pat. No. 4,339,391, Hoffman et al., issued Jul. 13, 1982, said patents being incorporated herein by reference.

Examples of Compound (I) are dialkylenedimethylammonium salts such as dicanoladimethylammonium chloride, dicanoladimethylammonium methylsulfate, di(partially hydrogenated soybean, cis/trans ratio of about 4:1) dimethylammonium chloride, dioleyldimethylammonium chloride. Dioleyidimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (2) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (3) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a difatty amidoamine based compound having the formula:

$$[R^1—C(O)—NH—CH_2CH_2—N(CH_3)(CH_2CH_2OH)—CH_2CH_2—NH—C(O)—R^1]^+CH_3SO_4^-$$

wherein $R^1$—C(O) is oleoyl group, available commercially from the Witco Corporation under the trade name Varisoft® 222LT.

An example of Compound (6) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

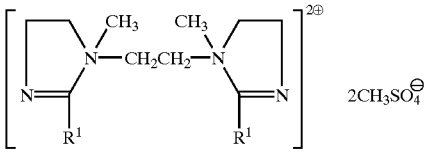

wherein $R^1$ is derived from oleic acid, and the compound is available from Witco Company.

An example of Compound (11) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Anion $A^-$

In the cationic nitrogenous salts herein, the anion $A^-$, which is any compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion $A^-$. The anion can also, but less preferably, carry a double charge in which case $A^-$ represents half a group.

2. Biguanide Compounds

Other useful cationic surfactants herein include biguanide compounds. As with the quaternary compounds described hereinbefore, many biguanide compounds exhibit antimicrobial effectiveness, depending on the level of the biguanide compound in the compositions. Especially useful biguanide compounds include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a cationic surfactant in dilute versions of the present invention, it is typically present at a level from about 0.0001% to about 10%, preferably from about 0.001% to about 7%, and more preferably from about 0.01% to about 5%, by weight of the composition. When used in concentrate versions of the present invention, it is typically present at a level from about 0.001% to about 70%, preferably from about 0.01% to about 60%, and more preferably from about 0.1% to about 50%, by weight of the composition. In some cases, a level from about 0.001% to about 10% in the dilute compositions and a level from about 0.01% to about 70% in the concentrate compositions may be needed for antimicrobial and/or virucidal activity.

Other useful biguanide compounds include Cosmoci® CQ®, Vantocil® IB, including poly (hexamethylene biguanide) hydrochloride. Other useful cationic surfactants include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane) dihydrochloride; 1,6-di-($N_1$,$N_1$'-phenyldiguanido-$N_5$,$N_5$')-hexane tetrahydrochloride; 1,6-di-($N_1$,$N_1$'-phenyl-$N_1$,$N_1$'-methyldiguanido-$N_5$,$N_5$')-hexane dihydrochloride; 1,6-di ($N_1$,$N_1$'-o-chlorophenyidiguanido-$N_5$,$N_5$')hexane dihydrochloride; 1,6-di($N_1$,$N_1$'-2,6-dichlorophenyidiguanido-$N_5$,$N_5$')hexane dihydrochloride; 1,6-di[$N_1$,$N_1$'-.beta.-(p-methoxyphenyl) diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$,$N_5$')hexane dihydrochloride;.omega.:.omega.'-di-($N_1$,$N_1$'-phenyldiguanido-$N_5$,$N_5$')-di-n-propylether dihydrochloride;.omega:omega'-di($N_1$,$N_1$'-p-chlorophenyidiguanido-N,N')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$')hexane dihydrochloride; 1,6-di($N_1$,$N_1$'-2,4,5-trichlorophenyldiguanido-$N_5$,$N_5$') hexane tetrahydrochloride; 1,6-di[$N_1$,$N_1$-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,10-di($N_1$,$N_1$'-phenyldiguanido-$N_5$,$N_5$')-decane tetrahydrochloride; 1,12-di($N_1$,$N_1$'-phenyldiguanido-$N_5$,$N_5$') dodecane tetrahydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; ethylene bis (1-tolyl biguanide); ethylene bis(p-tolyl biguanide); ethylene bis(3,5-dimethylphenyl biguanide); ethylene bis(p-tert-amylphenyl biguanide); ethylene bis(nonylphenyl biguanide); ethylene bis(phenyl biguanide); ethylene bis(N-butylphenyl biguanide); ethylene bis(2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis (phenylbiguanide); trimethylene bis(o-tolyl biguanide); N-butyl trimethylene bis(phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred cationic surfactants from this group are 1,6-di-($N_1$,$N_1$'-phenyidiguanido-$N_5$,$N_5$')-hexane tetrahydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyidiguanido-$N_5$,$N_5$')hexane dihydrochloride; 1,6-di($N_1$,$N_1$'-2,4-dichlorophenyidiguanido-$N_5$,$N_5$')hexane tetrahydrochloride; 1,6-di[$N_1$,$N_1$'-.alpha.-(p-chlorophenyl) ethyidiguanido-$N_5$,$N_5$'] hexane dihydrochloride;.omega.:.omega.'di($N_1$,$N_1$'-p-chlorophenyidiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyidiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyidiguanido-$N_5$,$N_5$')-hexane dihydrochloride; 1,6-di($N_1$,$N_1$'-2,6-dichlorophenyidiguanido-$N_5$,$N_5$')hexane dihydrochloride; 1,6-di($N_1$,$N_1$'-2,4-dichlorophenyidiguanido-$N_5$,$N_5$')hexane tetrahydrochloride; 1,6-di[$N_1$,$N_1$'-.alpha.-(p-chlorophenyl) ethyidiguanido-$N_5$,$N_5$'] hexane dihydrochloride;.omega.:.omega.'di($N_1$,$N_1$'-p-chlorophenyidiguanido-$N_5$,$N_5$')m-xylene dihydrochloride; 1,12-di($N_1$,$N_1$'-p-chlorophenyidiguanido-$N_5$,$N_5$') dodecane dihydrochloride; 1,6-di($N_1$,$N_1$'-o-chlorophenyidiguanido- $N_5,N_5'$) hexane dihydrochloride; 1,6-di($N_1,N_1'$-p-chlorophenyldiguanido-$N_5,N_5'$)-hexane tetrahydrochloride; and mixtures thereof. As stated hereinbefore, the bis biguanide compound of choice is chlorhexidine and its salts, e.g., digluconate, dihydrochloride, diacetate, and mixtures thereof.

D. Aqueous Carrier

The compositions of the present invention comprise an aqueous carrier that comprises water. The water which is used can be distilled, deionized, or tap water. Water not only serves as the liquid carrier for the other materials in the compositions, but it also facilitates the complexation reaction between the cyclodextrin molecules and any unwanted molecules on surfaces, such as malodorous molecules that are on inanimate surfaces such as fabric, when the surface is treated. It has been discovered that the intensity of unwanted malodorous molecules generated by some polar, low molecular weight organic amines, acids, and mercaptans is reduced when the malodor-contaminated surfaces are treated with an aqueous solution. Not to be bound by theory, it is believed that water solubilizes and depresses the vapor pressure of these polar, low molecular weight organic molecules, thus reducing their odor intensity. Also, water aids the ability of the compositions herein to reduce the appearance of wrinkles on fabrics.

The level of water in the present compositions can vary dependent upon the use of the composition. In the dilute compositions designed to be sprayed from manually or non-manually operated sprayers, the level of water is preferably high, from about 30% to about 99.9%, more preferably from about 40% to about 99.5%, and still more preferably from about 50% to about 99%. In the concentrated compositions herein, the level of water is typically from about 5% to about 95%, preferably from about 10% to about 90%, and more preferably from about 20% to about 90%.

The aqueous carrier can further comprise one or more monohydric and/or polyhydric alcohols. Dilute aqueous compositions that contain up to 20% alcohol, preferably up to about 10% alcohol, and more preferably from up to about 5% alcohol, and concentrate aqueous compositions that contain up to 70% alcohol, preferably up to about 50% alcohol, and more preferably up to about 45% alcohol, are preferred for odor and/or wrinkle controlling compositions for treating fabrics. In compositions of the present invention that comprise the optional cyclodextrin odor control agent, the dilute aqueous compositions provide the maximum separation of cyclodextrin molecules on the fabric and thereby maximizes the chance that an odor molecule will interact with a cyclodextrin molecule.

E. Other Optional Ingredients

1. Additional Co-Surfactant

The stable, aqueous compositions of the present invention can optionally further comprise an additional co-surfactant, in addition to the polyalkyleneoxide polysiloxane surfactants and/or cationic surfactants. The additional co-surfactant can be selected from the group consisting of nonionic surfactants, anionic surfactants, zwitterionic surfactants, fluorocarbon surfactants, and mixtures thereof. Preferably, any additional co-surfactant, if present, is a nonionic surfactant, and more preferably a castor oil surfactant.

When the present compositions comprise the optional cyclodextrin as an odor control agent, any additional co-surfactant incorporated into the present composition will preferably be a cyclodextrin-compatible co-surfactant. Cyclodextrin-compatible surfactants described herein are either weakly interactive with cyclodextrin (less than 5% elevation in surface tension), or non-interactive (less than 1% elevation in surface tension). Normal surfactants like sodium dodecyl sulfate and dodecanolpoly(6)ethoxylate are strongly interactive, with more than a 10% elevation in surface tension in the presence of a typical cyclodextrin like hydroxypropyl beta-cyclodextrin and methylated beta-cyclodextrin.

Typical levels of additional co-surfactant, if present, in the stable, aqueous compositions D herein are from about 0.0001% to about 10%, preferably from about 0.001% to about 7%, more preferably from about 0.01% to about 5%, by weight of the composition. Typical levels of additional co-surfactant, if present, in concentrated compositions are from about 0.001% to about 70%, preferably from about 0.01% to about 60%, more preferably from about 0. 1% to about 50%, by weight of the concentrated composition.

a. Nonionic Surfactants

Nonionic surfactants are the preferred additional co-surfactants herein, if a co-surfactant is present in the compositions. Suitable nonionic surfactants include, but are not limited to, alkyl ethoxylated surfactants, block copolymer surfactants, castor oil surfactants, sorbitan ester surfactants, polyethoxylated fatty alcohol surfactants, glycerol mono-fatty acid ester surfactants, polyethylene glycol fatty acid ester surfactants, and mixtures thereof.

i. Alkyl Ethoxylated Surfactants

A preferred, but nonlimiting, type of nonionic surfactant is alkyl ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. The ethoxylated surfactant includes compounds having the general formula:

$$R^8—Z—(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is hydrogen, a carboxylate group, or a sulfate group; and linking group Z is selected from the group consisting of: —O—, —$N(R)_x$—, —C(O)O—, —C(O)N(R)—, —C(O)N(R)—, and mixtures thereof, in which R, when present, is $R^8$, a lower alkyl with about 1 to about 4 carbons, a polyalkylene oxide, or hydrogen, and x is 1 or 2.

The nonionic alkyl ethoxylated surfactants herein are characterized by an HLB (hydrophilic-lipophilic balance) of from about 5 to about 20, preferably from about 6 to about 15.

Nonlimiting examples of preferred alkyl ethoxylated surfactants are:

- straight-chain, primary alcohol ethoxylates, with R8 being $C_8$–$C_{26}$ alkyl and/or alkenyl group, more preferably $C_{10}$–$C_{18}$, and s being from about 2 to about 100, preferably from about 2 to about 80;
- straight-chain, secondary alcohol ethoxylates, with $R^8$ being $C_8$–$C_{26}$ alkyl and/or alkenyl, e.g., 3-hexadecyl, 2-octadecyl, 4-eicosanyl, and 5-eicosanyl, and s being from about 2 to about 100;
- alkyl phenol ethoxylates wherein the alkyl phenols having an alkyl or alkenyl group containing from about 3 to about 26 carbon atoms in a primary, secondary or branched chain configuration, preferably from about 6 to about 22 carbon atoms, and s is from about 2 to about 100, preferably from about 2 to about 80;

branched chain alcohol ethoxylates, wherein branched chain primary and secondary alcohols (or Guerbet alcohols) which are available, e.g., from the well-known "OXO" process, or modification thereof, are ethoxylated.

Especially preferred are alkyl ethoxylate surfactants with each $R^8$ being $C_8$–$C_{26}$ straight chain and/or branch chain alkyl and the number of ethyleneoxy groups s being from about 2 to about 100, preferably from about 2 to about 80, more preferably with $R^8$ being $C_8$–$C_{22}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91-2.5 ($C_9$–$C_{10}$, s=2.7, HLB=8.5), Neodol 23-3 ($C_{12}$–$C_{13}$, s=2.9, HLB=7.9) and Neodol 25-3 ($C_{12}$–$C_{15}$, s=2.8, HLB=7.5). It is found, very surprisingly, that these preferred surfactants which are themselves not very water soluble (0.1% aqueous solutions of these surfactants are not clear), can at low levels, effectively emulsify and or disperse silicone oils and these surfactants can also solubilize and/or disperse shape retention polymers such as copolymers containing acrylic acid and tert-butyl acrylate into clear compositions, even without the presence of a low molecular weight alcohol. Many nonlimiting examples of suitable nonionic surfactants are given in the table below.

Other useful nonionic alkyl alkoxylated surfactants are ethoxylated alkyl amines derived from the condensation of ethylene oxide with hydrophobic alkyl amines, with $R^8$ having from about 8 to about 22 carbon atoms and s being from about 3 to about 30.

Other examples of useful ethoxylated surfactants include carboxylated alcohol ethoxylate, 5 also known as ether carboxylate, with $R^8$ having from about 12 to about 26 carbon atoms and s being from about 5 to about 100; ethoxylated alkyl amine or quaternary ammonium surfactants, $R^8$ having from about 8 to about 26 carbon atoms and s being from about 3 to about 100, such as PEG-5 cocomonium methosulfate, PEG-15 cocomonium chloride, PEG-15 oleammonium chloride and bis(polyethoxyethanol) tallow ammonium chloride.

TABLE 1

Nonlimiting Examples of Some Suitable Nonionic Surfactants.

| Name | Structure | HLB Value | Suppliers |
|---|---|---|---|
| Neodol ® 91-2.5 | $C_9$-$C_{10}$-2.7EO | 8.5 | Shell Chemical Co. |
| Neodol ® 23-1 | $C_{12}$-$C_{13}$-1.0EO | 3.7 | Shell Chemical Co. |
| Neodol ® 23-2 | $C_{12}$-$C_{13}$-2.0EO | 5.9 | Shell Chemical Co. |
| Neodol ® 23-3 | $C_{12}$-$C_{13}$-2.9EO | 7.9 | Shell Chemical Co. |
| Neodol ® 25-3 | $C_{12}$-$C_{15}$-2.8EO | 7.5 | Shell Chemical Co. |
| Neodol ® 23-5 | $C_{12}$-$C_{13}$-5.0EO | 10.7 | Shell Chemical Co. |
| Neodol ® 25-9 | $C_{12}$-$C_{15}$-8.9EO | 13.1 | Shell Chemical Co. |
| Neodol ® 25-12 | $C_{12}$-$C_{15}$-11.9EO | 14.4 | Shell Chemical Co. |
| Hetoxol ® TD-3 | $C_{13}$-3EO | 7.9 | Heterene Inc. |
| Hetoxol ® OL-5 | Oleyl-5EO | 8.0 | Heterene Inc. |
| Kessco ® PEG-8 Mono-oleate | Oleoyl-8EO | 11.0 | Stepan Co. |
| Kessco ® Glycerol monooleate | Glyceryl mono-oleate | 3.8 | Stepan Co. |
| Arlacel ® 20 | Sorbitan mono-laurate | 8.6 | ICI Americas |

ii. Block Copolymer Surfactants

Nonlimiting examples of cyclodextrin-compatible nonionic surfactants include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

Nonlimiting examples of cyclodextrin-compatible surfactants of this type include:

Pluronic Surfactants with the general formula $H(EO)_n(PO)_m(EO)_nH$, wherein EO is an ethylene oxide group, PO is a propylene oxide group, and n and m are numbers that indicate the average number of the groups in the surfactants. Typical examples of cyclodextrin-compatible Pluronic surfactants are:

| Name | Average MW | Average n | Average m |
|---|---|---|---|
| L-101 | 3,800 | 4 | 59 |
| L-81 | 2,750 | 3 | 42 |
| L-44 | 2,200 | 10 | 23 |
| L-43 | 1,850 | 6 | 22 |
| F-38 | 4,700 | 43 | 16 |
| P-84 | 4,200 | 19 | 43, |

and mixtures thereof.

Tetronic Surfactants with the general formula:

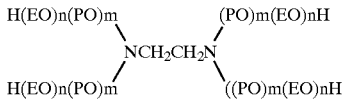

wherein EO, PO, n, and m have the same meanings as above. Typical examples of cyclodextrin-compatible Tetronic surfactants are:

| Name | Average MW | Average n | Average m |
|---|---|---|---|
| 901 | 4,700 | 3 | 18 |
| 908 | 25,000 | 114 | 22, |
| and mixtures thereof. | | | |

and mixtures thereof.

"Reverse" Pluronic and Tetronic surfactants have the following general formulas:

Reverse Pluronic Surfactants $H(PO)_m(EO)_n(PO)_mH$

Reverse Tetronic Surfactants

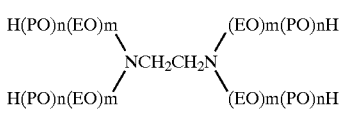

wherein EO, PO, n, and m have the same meanings as above. Typical examples of cyclodextrin-compatible Reverse Pluronic and Reverse Tetronic surfactants are:

| Name | Average MW | Average n | Average m |
|---|---|---|---|
| | Reverse Pluronic surfactants: | | |
| 10 R5 | 1,950 | 8 | 22 |
| 25 R1 | 2,700 | 21 | 6 |
| | Reverse Tetronic surfactants | | |
| 130 R2 | 7,740 | 9 | 26 |
| 70 R2 | 3,870 | 4 | 13 |
| and mixtures thereof. | | | |

iii. Castor Oil Surfactants

The cyclodextrin-compatible surfactants useful in the present invention to form molecular aggregates, such as micelles or vesicles, with the cyclodextrin-incompatible materials of the present invention further include polyoxyethylene castor oil ethers or polyoxyethylene hardened castor oil ethers or mixtures thereof, which are either partially or fully hydrogenated. These ethoxylates have the following general formulae:

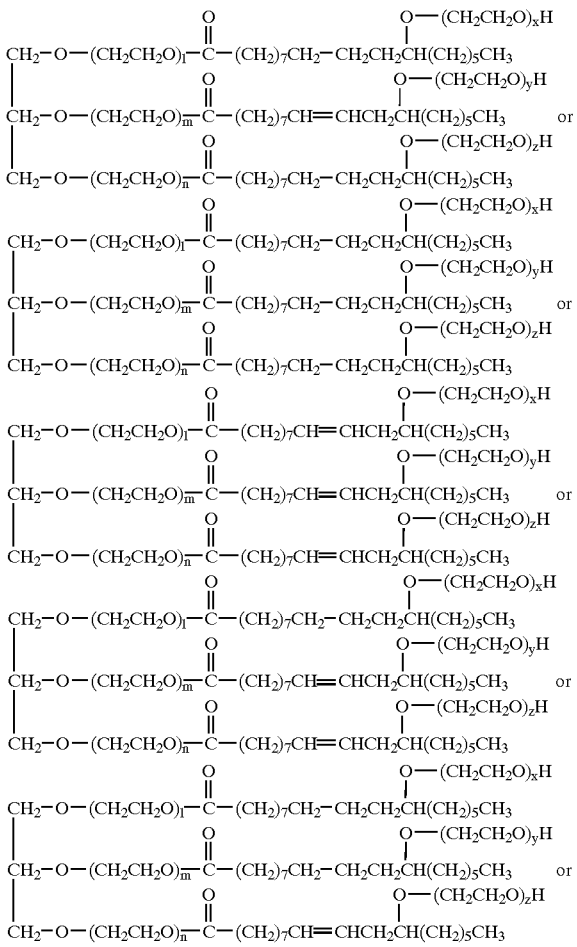

-continued

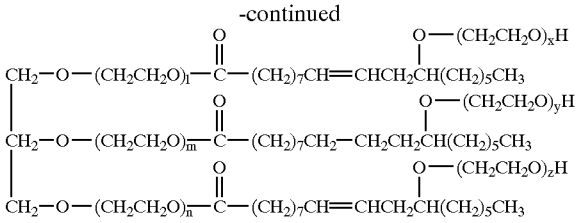

These ethoxylates can be used alone or in any mixture thereof. The average ethylene oxide addition mole number (i.e., l+m+n+x+y+z in the above formula) of these ethoxylates is generally from about 7 to about 100, and preferably from about 20 to about 80. Castor oil surfactants are commerically available from Nikko under the trade names HCO 40 and HCO 60 and from BASF under the trade names Cremphor™ RH 40, RH 60, and CO 60.

iv. Sorbitan Ester Surfactants

The sorbitan esters of long-chain fatty acids usable as cyclodextrin-compatible surfactants to form molecular aggregates with cyclodextrin-incompatible materials of the.present invention include those having long-chain fatty acid residues with 14 to 26 carbon atoms, desirably 16 to 22 carbon atoms. Furthermore, the esterification degree of the sorbitan polyesters of long-chain fatty acids is desirably 2.5 to 3.5, especially 2.8 to 3.2. Typical examples of these sorbitan polyesters of long-chain fatty acids are sorbitan tripalmitate, sorbitan trioleate, and sorbitan tallow fatty acid triesters.

Other suitable sorbitan ester surfactants include sorbitan fatty acid esters, particularly the mono-and tri-esters of the formula:

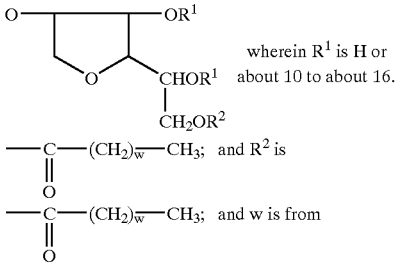

Further suitable sorbitan ester surfactants include polyethoxylated sorbitan fatty acid esters, particularly those of the formula:

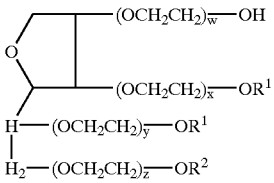

wherein $R^1$ is H or

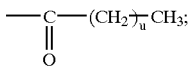

and $R^2$ is

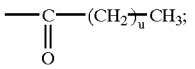

u is from about 10 to about 16 and average (w+x+y+z) is from about 2 to about 100. Preferably, u is 16 and average (w+x+y+z) is from about 2 to about 4.

v. Polyethoxylated Fatty Alcohol Surfactants

Cyclodextrin-compatible surfactants further include polyethoxylated fatty alcohol surfactants having the formula:

$$CH_3—(CH_2)_x—(CH=CH)_y—(CH_2)_z—(OCH_2CH_2)_w—OH$$

wherein w is from about 0 to about 100, preferably from about 0 to about 80; y is 0 or 1; x is from about 1 to about 10; z is from about 1 to about 10; x+z+y =I I to 25, preferably 11 to 23.

Branched (polyethoxylated) fatty alcohols having the following formula are also suitable as cyclodextrin-compatible surfactants in the present compositions:

$$R—(OCH_2CH_2)_w—OH$$

wherein R is a branched alkyl group of from about 10 to about 26 carbon atoms and w is as specified above.

vi. Glycerol Mono-Fatty Acid Ester Surfactants

Further cyclodextrin-compatible surfactants include glycerol mono-fatty acid esters, particularly glycerol monostearate, oleate, palmitate or laurate.

vii. Polyethylene Glycol Fatty Acid Ester Surfactants

Fatty acid esters of polyethylene glycol, particularly those of the following formula, are cyclodextrin-compatible surfactants useful herein:

$$R^1—(OCH_2CH_2)_w—OH$$

-or- $$R^1—(OCH_2CH_2)_wOR^1$$

wherein $R^1$ is a stearoyl, lauroyl, oleoyl or palmitoyl residue; w is from about 2 to about. 100, preferably from about 2 to about 80.

b. Anionic Surfactants

Anionic surfactants can optionally be incorporated in the present compositions as an additional co-surfactant. Many suitable nonlimiting examples from the class of anionic surfactants can be found in *Surfactants and Interfacial Phenomena,* 2$^{nd}$ Ed., Milton J. Rosen, 1989, John Wiley & Sons, Inc., pp. 7–16, which is hereby incorporated by reference. Additional suitable nonlimiting examples of anionic surfactants can be found in *Handbook of Surfactants,* M. R. Porter, 1991, Blackie & Son Ltd, pp. 54–115 and references therein, the disclosure of which is incorporated herein by reference.

Structurally, suitable anionic surfactants contain at least one hydrophobic moiety and at least one hydrophilic moiety. The surfactant can contain multiple hydrophobic moieties and/or multiple hydrophilic moieties, but preferably less than or equal to about 2 hydrophobic moieties and less than or equal to about 3 hydrophilic moieties. The hydrophobic moiety is typically comprised of hydrocarbons either as an alkyl group or an alkyl-aryl group. Alkyl groups typically contain from about 6 to about 22 carbons, preferably about 10 to about 18 carbons, and more preferably from about 12 to about 16 carbons; aryl groups typically contain alkyl groups containing from about 4 to about 6 carbons. Each alkyl group can be a branched or linear chain and is either saturated or unsaturated. A typical aryl group is benzene. Some typical hydrophilic groups for anionic surfactants include but are not limited to $—CO_2^-$, $—OSO_3^-$, $—SO_3^-$, $—(OR_1)_x—CO_2^-$, $—(OR_1)_x—OSO_3^-$, $—(OR_1)_x—SO_3^-$ where x is being less than about 10 and preferably less than about 5. Some nonlimiting examples of suitable surfactants includes, Stepanol® WAC, Biosoft® 40 (Stepan Co., Northfield, Ill.).

Anionic surfactants can also be created by sulfating or sulfonating animal or vegetable based oils. An example of these type of surfactants include sulfated canola oil and sulfated castor oil (Freedom SCO-75) available from the Freedom Chemical Co., Charlotte NC (owned by BF Goodrich).

Nonlimiting examples of cyclodextrin-compatible anionic surfactants are the alkyldiphenyl oxide disulfonate, having the general formula:

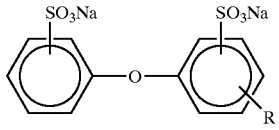

wherein R is an alkyl group. Examples of this type of surfactants are available from the Dow Chemical Company under the trade name Dowfax® wherein R is a linear or branched $C_6$–$C_{16}$ alkyl group. An example of these cyclodextrin-compatible anionic surfactant is Dowfax 3B2 with R being approximately a linear $C_{10}$ group.

c. Zwitterionic Surfactants

Zwitterionics are suitable for use in the present invention as optional additional co-surfactants. Zwitterionic surfactants, also referred to as amphoteric surfactants, comprise moieties that can have both negative and positive charges. Zwitterionics have advantages over other surfactants since these are less irritating to the skin and yet still provide good wetting. Some nonlimiting examples of zwitterionic surfactants useful for the present invention are: betaines, amine-oxides, sulfobetaines, sultaines, glycinates, aminoipropionates, imidazoline-based amphoterics. Various zwitterionic surfactants are disclosed in the "Handbook of Surfactants" by M. R. Porter, Chapman & Hall, 1991 and references therein and in "Surfactants and Interfacial Phenomena" by M. Rosen, 2$^{nd}$ Ed., John Wiley & Sons, 1989 and references therein, which are incorporated herein by reference. Zwitterionics disclosed in the "Handbook of Surfactants" and in "Surfactants and Interfacial Phenomena" and references therein are incorporated herein by reference.

d. Fluorocarbon Surfactants

Further optional additional co-surfactants useful in the present compositions include fluorocarbon surfactants. Fluorocarbon surfactants are a class of surfactants wherein the hydrophobic part of the amphiphile comprises at least in part some portion of a carbon-based linear or cyclic moiety having fluorines attached to the carbon where typically hydrogens would be attached to the carbons together with a hydrophilic head group. Some typical nonlimiting fluorocarbon surfactants include fluorinated alkyl polyoxyalkylene, and fluorinated alkyl esters as well as ionic surfactants. Representative structures for these compounds are given below:

(1) $R_fR(R_1O)_xR_2$ (2) $R_fR—OC(O)R_3$ (3) $R_fR—Y—Z$ (4) $R_fRZ$ wherein $R_f$ contains from about 6 to about 18 carbons each having from about 0 to about 3 fluorines attached. R is either an alkyl or alkylene oxide group which, when present, has from about 1 to about 10 carbons and $R_1$ represents an alkylene radical having from about 1 to about 4 carbons. $R_2$ is either a hydrogen or a small alkyl capping group having from about 1 to about 3 carbons. $R_3$ represents a hydrocarbon moiety comprising from about 2 to about 22 including the carbon on the ester group. This hydrocarbon can be linear, branched or cyclic saturated or unsaturated and contained moieties based on oxygen, nitrogen, and sulfur including, but not limited to ethers, alcohols, esters, carboxylates, amides, amines, thio-esters, and thiols; these oxygen, nitrogen, and sulfur moieties can either interrupt the hydrocabon chain or be pendant on the hydrocarbon chain. In structure 3, Y represents a hydrocarbon group that can be an alkyl, pyridine group, amidopropyl, etc. that acts as a linking group between the fluorinated chain and the hydrophilic head group. In structures 3 and 4, Z represents a cationic, anionic, and amphoteric hydrophilic head groups including, but not limited to carboxylates, sulfates, sulfonates, quaternary ammonium groups, and betaines. Nonlimiting commercially available examples of these structures include Zonyl® 9075, FSO, FSN, FS-300, FS-310, FSN-100, FSO-100, FTS, TBC from DuPont and Fluorad™ surfactants FC-430, FC-431, FC-740, FC-99, FC-120, FC-754, FC170C, and FC-171 from the 3M™ company in St. Paul, Minn.

2. Odor Control Agent

The present compositions can optionally further comprise an effective amount of odor control agent to significantly reduce malodor impression that exists on surfaces, especially on fabrics. The amount required to significantly reduce malodor impression on surfaces, especially fabrics, typically varies according to the particular odor control agent as described hereinafter. The odor control agent is preferably selected from the group consisting of: cyclodextrin, preferably solubilized, uncomplexed cyclodextrin; odor blocker; class I aldehydes; class II aldehydes; flavanoids; and mixtures thereof.

a. Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on fabrics, e.g. as the composition dries on the treated fabrics. As the water is being removed however, e.g., water is being extracted from carpet by a carpet extractor, some low molecular weight organic amines and acids have more affinity and will complex with the cyclodextrins more readily.

The cavities within the cyclodextrin in the stable, aqueous composition of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) under the conditions of use at room temperature.

Preferably, the cyclodextrin used in the present invention is highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $^-CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference. Further cyclodextrin derivatives suitable herein include those disclosed in V. T. D'Souza and K. B. Lipkowitz, CHEMICAL REVIEWS: CYLCODEXTRINS, Vol. 98, No. 5 (American Chemical Society, July/August 1998), which is incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabrics.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrin is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Uncomplexed cyclodextrin molecules, which are made up of varying numbers of glucose units provide the absorbing advantages of known absorbent deodorizing compositions without harmful effects to fabrics. While cyclodextrin is an effective odor absorbing active, some small molecules are not sufficiently absorbed by the cyclodextrin molecules because the cavity of the cyclodextrin molecule may be too large to adequately hold the smaller organic molecule. If a small sized organic odor molecule is not sufficiently absorbed into the cyclodextrin cavity, a substantial amount of malodor can remain. In order to alleviate this problem, low molecular weight polyols can be added to the composition to enhance the formation of cyclodextrin inclusion complexes. Furthermore, optional water soluble metal salts can be added as discussed hereinafter, to complex with some nitrogen-containing and sulfur-containing malodor molecules.

When dilute compositions are used, the level of cyclodextrin is from about 0.3% to about 50%, more preferably from about 0.5% to about 40%, by weight of the composition. When concentrated compositions are used, the level of cyclodextrin is from about 2% to about 80%, more preferably from about 3% to about 70%, by weight of the concentrated composition.

b. Odor Blockers

Although not as preferred as cyclodextrin, "odor blockers" can be used as an odor control agent to mitigate the effects of malodors. In order to be effective, the odor blockers normally have to be present at all times. If the odor blocker evaporates before the source of the odor is gone, it is less likely to control the odor. Also, the odor blockers tend to adversely affect aesthetics by blocking desirable odors like perfumes.

Suitable odor blockers are disclosed in U.S. Pat. Nos. 4,009,253; 4,187,251, 4,719,105; 5,441,727; and 5,861,371, said patents being incorporated herein by reference.

c. Aldehydes

As an optional odor control agent, aldehydes can be used to mitigate the effects of malodors. Suitable aldehydes are class I aldehydes, class II aldehydes, and mixtures thereof, that are disclosed in U.S. Pat. No. 5,676,163, said patent being incorporated herein by reference.

d. Flavanoids

Flavanoids are ingredients found in typical essential oils. Such oils include essential oil extracted by dry distillation from needle leaf trees and grasses such as cedar, Japanese cypress, eucalyptus, Japanese red pine, dandelion, low striped bamboo and cranesbill and it contains terpenic material such as alpha-pinene, beta-pinene, myrcene, phencone and camphene. The terpene type substance is homogeneously dispersed in the finishing agent by the action of nonionic surfactant and is attached to fibres constituting the cloth. Also included are extracts from tea leaf. Descriptions of such materials can be found in JP6219157, JP 02284997, JP04030855, etc. said references being incorporated herein by reference.

e. Metallic Salts

The odor control agent of the present invention can include metallic salts for added odor absorption and/or antimicrobial benefit, especially where cyclodextrin is also present as an odor control agent in the composition. The metallic salts are selected from the group consisting of copper salts, zinc salts, and mixtures thereof.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4., 1983, to N. B. Shah, et al., all of which are incorporated herein by reference. Highly-ionized and soluble zinc salts such as zinc chloride, provide the best source of zinc ions. Zinc borate can function as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention as an odor control agent primarily to absorb amine and sulfur-containing compounds. These compounds have molecular sizes too small to be effectively complexed with a cyclodextrin odor control agent. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

Copper salts possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference. Copper salts also have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide.

When metallic salts are added to the composition of the present invention as an odor control agent, they are typically present at a level of from about 0.1% to an effective amount to provide a saturated salt solution, preferably from about 0.2% to about 25%, more preferably from about 0.3% to about 8%, still more preferably from about 0.4% to about 5% by weight of the usage composition.

3. Supplemental Fabric Wrinkle Control Agents

The stable, aqueous compositions herein can further comprise an effective amount of a supplemental fabric wrinkle control agent, in addition to the low molecular weight polyalkyleneoxide polysiloxanes described hereinbefore, that will provide enhanced body, form and drape control or smoothness to the fabrics treated with the present compositions. Preferably, these agents will be selected from the group consisting of fiber lubricants, shape retention polymers, hydrophilic plasticizers, lithium salts, and mixtures thereof.

a. Fiber Lubricants

The present invention may utilize a fiber lubricant to impart a lubricating property or increased gliding ability to fibers in fabric, particularly clothing. Not to be bound by theory, it is believed that water and other alcoholic solvents break or weaken the hydrogen bonds that hold the wrinkles, thus the fabric lubricant facilitates the fibers to glide on one another to further release the fibers from the wrinkle condition in wet or damp fabric. After the fabric is dried, a residual fiber lubricant can provide lubricity to reduce the tendency of fabric re-wrinkling.

i. Silicone Polymers

The present invention may utilize silicone as a supplemental fabric wrinkle control agent to impart an enhanced lubricating property or increased gliding ability to fibers in fabric, particularly clothing. Although silicones can be utilized as supplemental fabric wrinkle control agents, such compounds are not desirable in the present compositions because the compositions already contain low molecular weight polyalkyleneoxide polysiloxanes. Thus, the present compositions are preferably essentially free of, or free of, additional silicone materials, except for the low molecular weight polyalkyleneoxide polysiloxane surfactants described hereinbefore. It is especially preferred that the present compositions are essentially free of, or free of, additional volatile silicone oil materials, other than the low molecular weight polyalkyleneoxide polysiloxane surfactants.

Nonetheless, it is possible, although not preferred, to incorporate additional silicones in the present compositions. Nonlimiting examples of useful silicones include noncurable silicones such as polydimethylsilicone, relatively high molecular weight polyalkyleneoxide modified polydimethylsilicone, amino and quaternary modified silicones and volatile silicones, and curable silicones such as aminosilicones and hydroxysilicones. Preferred silicone supplemental wrinkle control agents include polyalkyleneoxide polysiloxanes having realtively high molecular weights, for example, a molecular weight of greater than about 1,000, preferably at least about 5,000, and more preferably at least about 10,000. Many types of aminofunctional silicones also cause fabric yellowing and such silicones are not preferred.

Non-limiting examples of silicones which are useful in the present invention are: non-volatile silicone fluids such as polydimethyl siloxane gums and fluids; volatile silicone fluid which can be a cyclic silicone fluid of the formula $[(CH_3)_2\ SiO]_n$ where n ranges between about 3 to about 7, preferably about 5, or a linear silicone polymer fluid having the formula $(CH_3)_3SiO[(CH_3)_2SiO]_mSi(CH_3)_3$ where m can be 0 or greater and has an average value such that the viscosity at 25° C. of the silicone fluid is preferably about 5 centistokes or less.

Thus one type of silicone that is useful in the composition of the present invention is polyalkyl silicone with the following structure:

$$A—(Si(R_2)—O—[Si(R_2)—O—]_q—Si(R_2)—A$$

The alkyl groups substituted on the siloxane chain (R) or at the ends of the siloxane chains (A) can have any structure as long as the resulting silicones remain fluid at room temperature.

Each R group preferably is alkyl, hydroxy, or hydroxyalkyl group, and mixtures thereof, having less than about 8, preferably less than about 6 carbon atoms, more preferably, each R group is methyl, ethyl, propyl, hydroxy group, and mixtures thereof. Most preferably, each R group is methyl. Aryl, alkylaryl and/or arylalkyl groups are not preferred. Each A group which blocks the ends of the silicone chain is hydrogen, methyl, methoxy, ethoxy, hydroxy, propoxy, and mixtures thereof, preferably methyl q is preferably an integer from about 7 to about 8,000.

The preferred silicones are polydimethyl siloxanes and preferably those polydimethyl siloxanes having a viscosity of from about 10 to about 1,000,000 centistokes at 25° C. Mixtures of volatile silicones and non-volatile polydimethyl siloxanes are also preferred. Preferably, the silicones are hydrophobic, non-irritating, non-toxic, and not otherwise harmful when applied to fabric or when they come in contact with human skin. Further, the silicones are compatible with other components of the composition are chemically stable under normal use and storage conditions and are capable of being deposited on fabric.

Suitable methods for preparing these silicone materials are described in U.S. Pat. Nos. 2,826,551 and 3,964,500. Silicones useful in the present invention are also commercially available. Suitable examples include silicones offered by Dow Corning Corporation and General Electric Company.

Other useful silicone materials, include materials of the formula:

$$HO—[Si(CH_3)_2—O]_x—\{Si(OH)[(CH_2)_3—NH—(CH_2)_2—NH_2]O\}_y—H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which can be used correspond to the formulas:

$$(R^1)_aG_{3-n}—Si—(—OSiG_2)_n—(OSiG_b(R^1)_{2-b})_m—O—SiG_{3-a}(R^1)_a$$

wherein G is selected from the group consisting of hydrogen, OH, and/or $C_1$–$C_5$ alkyl; a denotes 0 or an integer from 1 to 3; b denotes 0 or 1; the sum of n+m is a number from 1 to about 2,000; $R^1$ is a monovalent radical of formula $CpH_{2p}$ L in which p is an integer from 2 to 4 and L is selected from the group consisting of:

I. $—N(R^2)CH_2—CH_2—N(R^2)_2$;

II. $—N(R^2)_2$;

III. $—N+(R^2)_3\ A^-$; and

IV. $—N+(R^2)CH_2—CH_2N+H_2A^-$ wherein each $R^2$ is chosen from the group consisting of hydrogen, a $C_1$–$C_5$ saturated hydrocarbon radical, and each $A^-$ denotes compatible anion, e.g., a halide ion; and $$R^3—N+(CH_3)_2—Z—[Si(CH_3)_2O]_f—Si(CH_3)_2—Z—N+(CH_3)_2—R^3.2CH_3COO^-$$

wherein

I. z=$—CH_2—CH(OH)—CH_2O—CH_2)_2—$

II. $R^3$ denotes a long chain alkyl group; and

III. f denotes an integer of at least about 2.

In the formulas herein, each definition is applied individually and averages are included.

Another silicone material which can be used has the formula:

$$(CH_3)_3—Si—[OSi(CH_3)_2]_n—\{—O—Si(CH_3)[(CH_2)_3—NH—(CH_2)_2—NH_2]\}_mOSi(CH_3)_3$$

wherein n and m are the same as before. The preferred silicones of this type are those which do not cause fabric discoloration.

Alternatively, the silicone material can be provided as a moiety or a part of a non-silicone molecule. Examples of such materials are copolymers containing silicone moieties, typically present as block and/or graft copolymers.

When silicone is present as a supplemental wrinkle control agent, it is present at least an effective amount to provide lubrication of the fibers.

ii. Synthetic Solid Particles

Solid polymeric particles of average particle size smaller than about 10 microns, preferably smaller than 5 microns, more preferably smaller than about 1 micron, may be used as a lubricant, since they can provide a "roller-bearing" action. Polyethylene emulsions and suspensions are also suitable for providing this lubrication or smoothness effect to the fabrics on which they are deposited. Suitable smoothing agents are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention. The use of such polymers in fabric softening compositions is described in U.S. Pat. No. 5,830,843, b. Shape Retention Polymers Shape retention in fabrics can be imparted to the fabrics through the use of polymers that act by forming a film and/or by providing adhesive properties to the fabrics. These polymers may be natural, or synthetic. By "adhesive" it is meant that when applied as a solution or a dispersion, the polymer can attach to the surface of the fabric fibers and dry in place. The polymer can form a film on the fiber surfaces, or when residing between two fibers and in contact with the two fibers, it can bond the two fibers together. Other polymers such as starches can form a film and/or bond the fibers together when the treated fabric is pressed by a hot iron. Such a film will have adhesive strength, cohesive breaking strength, and cohesive breaking strain.

Nonlimiting examples of natural shape retention polymers are starches and their derivatives, and chitins and their derivatives. Starch is not normally preferred, since it makes the fabric resistant to deformation. However, it does provide increased "body" which is often desired. Starch is particularly preferred however, when the consumer intends to iron the fabrics after they have been washed and dried. When used, starch may be used as a solid or solubilized or dispersed to be combined with other materials in the composition. Any type of starch, e.g. those derived from corn, wheat, rice, grain sorghum, waxy grain sorghum, waxy maize or tapioca, or mixtures thereof and water soluble or dispersible modifications or derivatives thereof, can be used in the compositions of the present invention. Modified starches may include natural starches that have been degraded to obtain a lower viscosity by acidic, oxidative or enzymic depolymerization. Additionally, low viscosity commercially available propoxylated and/or ethoxylated starches are useable in the present composition and are preferred when the composition is to be dispensed with a sprayer because of their low viscosity at relatively high solid concentrations. Suitable alkoxylated, low viscosity starches are submicron-size particles of hydrophobic starch that are readily dispersed in water and are prepared by alkoxylation of granular starch with a monofunctional alkoxylating agent which provides the starch with ether linked hydrophilic groups. A suitable method for their preparation is taught in U.S. Pat. No. 3,462,283.

The synthetic polymers useful in the present invention are comprised of monomers. Nonlimiting examples of monomers which can be used to form the synthetic polymers useful in the present invention include: low molecular weight $C_1$–$C_6$ unsaturated organic mono- and polycarboxylic acids, such as acrylic acid, methacrylic acid, crotonic acid, maleic acid and its half esters, itaconic acid, and mixtures thereof; esters of said acids with $C_1$–$C_6$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof, amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), alkyl alcohol; esters of said alcohols with low molecular weight carboxylic acids, such as, vinyl acetate, vinyl propionate; ethers of said alcohols such as methyl vinyl ether; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof.

Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof. Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C. Most preferably, the adhesive polymer when dried to form a film will have a Tg of at least about 25° C., so that they are not unduly sticky or "tacky" to the touch.

Preferably the shape retention polymer is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which are useful as film-forming and/or adhesive polymers in the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); polyvinyl alcohol; polyvinylpyridine n-oxide; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride).

Nonlimiting examples of preferred polymers that are commercially available are polyvinylpyrrolidone/dimethylaminoethyl methacrylate copolymer, such as Copolymer 958, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

The preferred polymers that are useful in the present invention are selected from the group consisting of copolymers of hydrophilic monomers and hydrophobic monomers. The polymer can be linear random or block copolymers, and mixtures thereof. Such hydrophobic/hydrophilic copolymers typically have a hydrophobic monomer/hydrophilic monomer ratio of from about 95:5 to about 20:80, preferably from about 90:10 to about 40:60, more preferably from about 80:20 to about 50:50 by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water soluble" refers to a material that is soluble in distilled (or equivalent) water, at 25° C., at a concentration of about 0.2% by weight, and is preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophobic monomers are acrylic acid $C_1$–$C_6$ alkyl esters, such as methyl acrylate, ethyl acrylate, t-butyl acrylate; methacrylic $C_1$–$C_6$ alkyl esters, such as methyl methacrylate, methoxy ethyl methacrylate; vinyl alcohol esters of carboxylic acids, such as, vinyl acetate, vinyl propionate, vinyl ethers, such as methyl vinyl ether; vinyl chloride; vinylidene chloride; ethylene, propylene and other unsaturated hydrocarbons; and the like; and mixtures thereof Some preferred hydrophobic monomers are methyl acrylate, methyl methacrylate, t-butyl acrylate, t-butyl methacrylate, n-butyl acrylate, n-butyl methacrylate, and mixtures thereof.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Non limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); and resins sold under the trade names Ultrahold CA 8® by Ciba Geigy (ethyl acrylate/acrylic acid/N-t-butyl acrylamide copolymer); Resyn 28-1310® by National Starch and Luviset CA 66® by BASF (vinyl acetate/crotonic acid copolymer 90/10); Luviset CAP® by BASF (vinyl acetate/vinyl propionate/crotonic acid 50/40/10); Amerhold DR-25® by Union Carbide (ethyl acrylate/methacrylic acid/methyl methacrylate/acrylic acid copolymer), and Poligen A® by BASF (polyacrylate dispersion).

One highly preferred polymer is composed of acrylic acid and t-butyl acrylate monomeric units, preferably with acrylic acid/t-butyl acrylate ratio of from about 90:10 to about 10:90, preferably from about 70:30 to about 15:85, more preferably from about 50:50 to about 20:80, by weight of the polymer. Nonlimiting examples of acrylic acid/tert-butyl acrylate copolymers useful in the present invention are those with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

The film-forming and/or adhesive polymer is present in at least an effective amount to provide shape retention. It is not intended to exclude the use of higher or lower levels of the polymers, as long as an effective amount is used to provide adhesive and film-forming properties to the composition and the composition can be formulated and effectively applied for its intended purpose.

Other preferred adhesive and/or film forming polymers that are useful in the composition of the present invention actually contain silicone moieties in the polymers themselves, typically present as block and/or graft copolymers.

The preferred polymers for use herein have the characteristic of providing a natural appearing "drape" in which the fabric does not form wrinkles, or resists deformation.

c. Hydrophilic Plasticizer

Compositions may also contain a hydrophilic plasticizer to soften the fabric fibers, especially cotton fibers, and the adhesive and/or film-forming shape retention polymers. Examples of the preferred hydrophilic plasticizers are short chain polyhydric alcohols, such as glycerol, ethylene glycol, propylene glycol, diethylene glycol, dipropylene glycol, sorbitol, erythritol or mixtures thereof, more preferably diethylene glycol, dipropylene glycol, ethylene glycol, propylene glycol and mixtures thereof.

The aqueous compositions containing these plasticizers also tend to provide a slower drying profile for clothing/fabrics, to allow time for any wrinkles to disappear when the clothing/fabrics are hung to dry. This is balanced by the desire by most consumer to have the garments to dry faster. Therefore, when needed, the plasticizers should be used at an effective, but as low as possible, level in the composition.

d. Lithium Salts

The compositions of the present invention can further contain lithium salts and lithium salt hydrates as supplemental fabric wrinkle control agents to provide improved fabric wrinkle control. Nonlimiting examples of lithium salts that are useful in the present invention are lithium bromide, lithium bromide hydrate, lithium chloride, lithium chloride hydrate, lithium acetate, lithium acetate dihydrate, lithium lactate, lithium sulfate, lithium sulfate monohydrate, lithium tartrate, lithium bitartrate, and mixtures thereof, preferably lithium bromide, lithium lactate, and mixtures thereof.

As stated hereinbefore, the compositions of the present invention may also contain mixtures of fiber lubricant, shape retention polymer, plasticizer, and/or lithium salts to impart improved wrinkle control to the fabrics.

4. Perfume

The stable, aqueous compositions of the present invention preferably comprise perfume as an optional ingredient. Perfume is desireable in the present compositions to provide a freshness impression on the surface being treated by the stable, aqueous compositions of the present invention. Perfume is especially desired in compositions for treating fabrics, since it is important to provide a freshness impression on fabrics, especially clothing.

Suitable perfume materials for incorporation in the present compositions are disclosed in U.S. Pat. No. 5,939,060 issued Aug. 17, 1999 to Trinh et al. at col. 2, line 38 to col. 7, line 53, which is incorporated herein by reference.

If perfume is included in the stable, dilute aqueous compositions of the present invention, it is typically at the level from about 0.0001% to about 10%, preferably from about 0.001% to about 7%, and more preferably from about 0.01% to about 5%, by weight of the composition. If included in the stable, concentrate aqueous compositions, it is typically at the level from about 0.001% to about 70%, preferably from about 0.01% to about 60%, and more preferably from about 0.1% to about 50%, by weight of the composition.

5. Soil Suspending Agent

The stable, aqueous compositions herein can further comprise an optional soil suspending agent. The compositions optionally comprise at least about 0.01%, preferably at least about 0.05%, and to about 10%, preferably to about 5%, by weight, of a soil suspending agent such as a water-soluble substituted or unsubstituted, modified or unmodified polyalkyleneimine soil suspending agent, said soil suspending agent comprising a polyamine backbone, preferably said backbone having a molecular weight of from about 100 to about 5000 daltons having the formula:

$$[E_2N{-}R]_w[\overset{\overset{E}{|}}{N}{-}R]_x[\overset{\overset{B}{|}}{N}{-}R]_yNE$$

said backbones prior to subsequent modification, comprise primary, secondary and tertiary amine nitrogens connected by R "linking" units. The backbones are comprised of essentially three types of units, which may be randomly distributed along the chain.

The units which make up the polyalkyleneimine backbones are primary amine units having the formula:

$$H_2N{-}R]{-} \text{ and } {-}NH_2$$

which terminate the main backbone and any branching chains, secondary amine units having the formula:

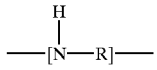

and which, after modification, have their hydrogen atoms preferably substituted by alkyleneoxy units as described herein below, and tertiary amine units having the formula:

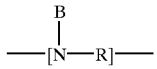

which are the branching points of the main and secondary backbone chains, B representing a continuation of the chain structure by branching. The tertiary units have no replaceable hydrogen atom and are therefore not modified by substitution with an alkyleneoxy unit.

R is $C_2$–$C_{12}$ alkylene, $C_3$–$C_6$ branched alkylene, and mixtures thereof, preferred branched alkylene is 1,2-propylene; most preferred R is ethylene. The preferred polyalkyleneimines of the present invention have backbones which comprise the same R unit, for example, all units are ethylene. Most preferred backbone comprises R groups which are all ethylene units.

The polyalkyleneimines of the present invention are modified by substitution of each N—H unit hydrogen with an alkyleneoxy unit having the formula:

$$—(R^1O)_nR^2$$

wherein $R^1$ is $C_2$–$C_{12}$ alkylene, preferably ethylene, 1,2-propylene, 1,3-propylene, 1,2-butylene, 1,4-butylene, and mixtures thereof, more preferably ethylene and 1,2-propylene, most preferably ethylene. $R^2$ is hydrogen, $C_1$–$C_4$ alkyl, and mixtures thereof, preferably hydrogen or methyl, more preferably hydrogen.

The molecular weight of the backbone prior to modification as well as the value of the index n is largely dependent upon the benefits and properties which the formulator wishes to provide. For example, U.S. Pat. No. 5,565,145 Watson et al., issued Oct. 15, 1996, discloses a preferred polyamine having a backbone $M_w$ of 1800 daltons and about 7 ethyleneoxy units per nitrogen as a modified polyalkyleneimine suitable for use as hydrophobic, inter alia, soot, grime, soil suspending agent. The substantivity of alkyleneoxy substituted polyamines toward fabric surface can be adjusted by the formulator to meet the needs of the specific embodiment.

U.S. Pat. No. 4,891,160 Vander Meer, issued Jan. 2, 1990; U.S. Pat. No. 4,597,898, Vander Meer, issued Jul. 1, 1986 describe a polyamine having a backbone $M_w$ of 189 daltons and an average of from about 15 to 18 ethyleneoxy units per nitrogen as a suitable soil suspending agent for hydrophilic, inter alia, clay soils.

A further description of polyamine soil suspending agents suitable for use in the present invention is found in; U.S. patent application Ser. No. 09/103,135; U.S. Pat. No. 6,004,922 Watson et al., issued Dec. 21, 1999; and U.S. Pat. No. 4,664,848 Oh et al., issued May 12, 1987 all of which are included herein by reference.

The polyamines herein can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

II. Methods of Use

The methods of the present invention relate to treating surfaces, preferably fabrics, with the stable, aqueous compositions of the present invention comprising the step of contacting the surface with the stable, aqueous composition. As used herein, the term "fabrics" is meant to encompass a variety of fabrics and articles composed of fabric and/or fibers, including but not limited to clothes, curtains, drapes, upholstered furniture, carpeting, bed linens, bath linens, tablecloths, sleeping bags, tents, car interior (e.g., car carpet, fabric car seats), and the like. The methods more specifically relate to reducing malodor impression on surfaces, especially fabrics, and/or reducing the appearance of wrinkles on fabrics. The surfaces are preferably treated by either spraying dilute aqueous compositions of the present invention onto the surfaces via a spray dispenser, or by adding the concentrated compositions of the present invention to, for example, a wash and/or rinse cycle in a typical laundry process.

A. MALODOR CONTROL

A preferred method herein includes a method of reducing malodor impression on a surface (preferably fabrics) having malodor impression, the method comprising the step of contacting the surface with a stable, aqueous composition as described hereinbefore.

The composition for reducing malodor impression herein can be used by distributing, e.g., by placing the aqueous solution into a dispensing means, preferably a spray dispenser and spraying an effective amount onto the desired surface or article. An effective amount as defined herein means an amount sufficient to absorb odor to the point that it is not discernible by the human sense of smell yet not so much as to saturate or create a pool of liquid on said article or surface and so that when dry there is no visual deposit readily discernible. Distribution can be achieved by using a spray device, a roller, a pad, etc. For odor control, an effective amount, as defined herein, means an amount sufficient to absorb odor to effect a noticeable reduction in the perceived odor, preferably to the point that it is not discernible, by the human sense of smell.

Preferably, the present invention does not encompass distributing the solution on to shiny surfaces including, e.g., chrome, glass, smooth vinyl, leather, shiny plastic, shiny wood, etc. It is preferable not to distribute the solution onto shiny surfaces because spotting and filming can more readily occur on the surfaces. Furthermore, the solution is not for use on human skin, especially when an antimicrobial preservative is present in the composition because skin irritation can occur.

The present invention encompasses the method of spraying an effective amount of the composition for reducing malodor onto household surfaces. Preferably said household surfaces are selected from the group consisting of countertops, cabinets, walls, floors, bathroom surfaces and kitchen surfaces.

The present invention encompasses the method of spraying a mist of an effective amount of the composition for reducing malodor onto fabric and/or fabric articles. Preferably, said fabric and/or fabric articles include, but are not limited to, clothes, curtains, drapes, upholstered furniture, carpeting, bed linens, bath linens, tablecloths, sleeping bags, tents, car interior, e.g., car carpet, fabric car seats, etc.

The present invention encompasses the method of spraying a mist of an effective amount of the composition for reducing malodor impression onto and into shoes wherein said shoes are not sprayed to saturation.

The present invention encompasses the method of spraying a mist of an effective amount of the composition for reducing malodor impression onto shower curtains.

The present invention relates to the method of spraying a mist of an effective amount of the composition for reducing malodor impression onto and/or into garbage cans and/or recycling bins.

The present invention relates to the method of spraying a mist of an effective amount of the composition for reducing malodor impression into the air to absorb malodor.

The present invention relates to the method of spraying a mist of an effective amount of the composition for reducing malodor impression into and/or onto major household appliances including but not limited to: refrigerators, freezers, washing machines, automatic dryers, ovens, microwave ovens, dishwashers etc., to absorb malodor.

The present invention relates to the method of spraying a mist of an effective amount of the composition for reducing malodor impression onto cat litter, pet bedding and pet houses to absorb malodor.

The present invention relates to the method of spraying a mist of an effective amount of the composition for reducing malodor impression onto household pets to absorb malodor.

B. WRINKLE CONTROL

Another preferred method herein includes a method of reducing the appearance of wrinkles on fabrics, the method comprising the step of contacting the fabric with a stable, aqueous composition as described hereinbefore. Preferably, this method further comprises the step of stretching or pulling the fabric, especially around the area of a wrinkle in the fabric. This method preferably further comprises the step of smoothing the fabric with a human hand or with an implement. This method is effective for reducing the appearance of wrinkles in fabrics.

The stable, aqueous compositions can be used by distributing, e.g., by placing, an effective amount of the composition onto the fabrics to be treated. Distribution can be achieved by using a spray device, a roller, a pad, etc., preferably a spray dispenser. For wrinkle control, an effective amount means an amount sufficient to remove or noticeably reduce the appearance of wrinkles on fabric. Preferably, the amount of solution is not so much as to saturate or create a pool of liquid on said article or surface and so that when dry there is no visual deposit readily discernible.

Preferably the stable, aqueous composition is dispensed from a spray dispenser as liquid droplets at near ambient temperature, and not as a hot steam to avoid the safety hazard of causing bums. The use of liquids without the necessity for heating is highly desirable for convenience as well.

Preferably, the methods of reducing the appearance of wrinkles does not encompass distributing the composition onto non-fabric surfaces. However, care should be taken when treating such composition on shiny surfaces including, e.g., chrome, glass, smooth vinyl, leather, shiny plastic, shiny wood, etc., because spotting and filming can occur on such surfaces.

The compositions and articles of the present invention which contain low molecular weight polyalkyleneoxide polysiloxane surfactants, either with or without a supplemental wrinkle control agent, can be used to treat fabrics, garments, and the like to remove or reduce, undesirable wrinkles, in addition to the optional removal or reduction of undesirable odor on said objects.

An effective amount of the liquid composition of the present invention is preferably sprayed onto fabrics, particularly clothing. When the composition is sprayed onto fabric, an effective amount should be deposited onto the fabric, with the fabric becoming damp or totally saturated with the composition, typically from about 5% to about 150%, preferably from about 10% to about 100%, more preferably from about 20% to about 75%, by weight of the fabric. Once an effective amount of the composition is sprayed onto the fabric the fabric is optionally, but preferably, stretched. The fabric is typically stretched perpendicular to the wrinkle. The fabric can also be smoothed by a human hand or by using an implement after it has been sprayed. The smoothing movement works particularly well on areas of clothing that have an interface sewn into them, or on the hems of clothing. Once the fabric has been sprayed and optionally, but preferably, stretched, it is hung until dry.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately.

In a still further aspect of the invention, the composition can be sprayed onto fabrics by in an in-home de-wrinkling chamber containing the fabric to be de-wrinkled and/or optionally deodorized, thereby providing ease of operation. Conventional personal as well as industrial deodorizing and/or de-wrinkling apparatuses are suitable for use herein. Traditionally, these apparatuses act by a steaming process which effects a relaxation of the fibers. Examples of home dewrinkling chambers include shower stalls. The spraying of the composition or compounds onto the fabrics can then occur within the chamber of the apparatus or before placing the fabrics into the chamber. Again, the spraying means should preferably be capable of providing droplets with a weight average diameter of from about 8 to about 100 $\mu$m, preferably from about 10 to about 50 $\mu$m. Preferably, the loading of moisture on fabrics made of natural and synthetic fibers is from about 5 to about 25%, more preferably from about 5 to about 10% by weight of the dried fabric. Other conventional steps that can be carried out in the dewrinkling apparatus can be applied such as heating and drying. Preferably, for optimum dewrinkling benefit, the temperature profile inside the chamber ranges from about 40° C. to about 80° C., more preferably from about 50° C. to about 70° C. The preferred length of the drying cycle is from about 15 to about 60 minutes, more preferably from about 20 to about 45 minutes.

The steaming step in the dewrinkling apparatus may also be eliminated if the composition is maintained at a temperature range from about 22° C. (about 72° F.) to about 76° C. (170° F.) before spraying.

The compositions herein are especially useful, when used to treat garments for extending the time before another wash cycle is needed. Such garments include uniforms and other garments which are normally treated in an industrial process, which can be de-wrinkled and/or refreshed and the time between treatments extended.

In another embodiment herein, the present methods also relate to adding the stable, aqueous compositions of the present invention to a laundry wash solution, such as in an automatic washing machine, during the wash and/or rinse cycle of a typical laundry process. For these methods, the compositions of the present invention are preferably concentrated. Also, for these methods, the compositions can contain a DEQA compound, which will typically enhance the softness of the fabrics being treated. In this embodiment, the method comprises the steps of placing fabrics in a laundry wash and/or rinse solution and then adding the composition of the present invention to the wash and/or rinse solution. These methods include methods of reducing malodor impression on the fabrics in the wash and/or rinse solutions, and/or methods of reducing the appearance of wrinkles on the fabrics in the wash and/or rinse solutions. This reduction is, of course, relative to the amounts of malodor impression and/or wrinkles on the fabrics before placing them in the wash and/or rinse solutions.

III. Articles of Manufacture

The stable, aqueous compositions of the present invention can also be used in an article of manufacture comprising said composition contained in a spray dispenser. Preferably the articles of manufacture are in association with instructions for how to use the composition to treat surfaces, espeically surfaces having malodor impression, or wrinkled fabrics including, e.g., the manner and/or amount of composition to spray, and the preferred ways of stretching and/or smoothing of the fabrics, as will be described with more detailed herein below. It is important that the instructions be as simple and clear as possible, so that using pictures and/or icons is desirable. Thus a set of instructions can comprise an instruction to reduce malodor impression on surfaces, especially fabrics, by following one or more of the methods described hereinbefore. A set of instructions can also comprise an instruction to reduce the appearance of wrinkles in fabrics by carrying out one or more of the methods described hereinbefore.

As used herein, the phrase "in association with" means the set of instructions are either directly printed on the container itself or presented in a separate manner including, but not limited to, a brochure, print advertisement, electronic advertisement, and/or verbal communication, so as to communicate the set of instructions to a consumer of the article of manufacture. The set of instructions preferably comprises the instruction to apply an effective amount of the composition, preferably by spraying, to provide the indicated benefit, e.g., wrinkle reduction and/or reduction of malodor impression.

Spray Dispenser

The article of manufacture herein comprises a spray dispenser. The fabric wrinkle control composition is placed into a spray dispenser in order to be distributed onto the fabric. Said spray dispenser for producing a spray of liquid droplets can be any of the manually activated means as is known in the art, e.g. trigger-type, pump-type, non-aerosol self-pressurized, and aerosol-type spray means, for treating the wrinkle control composition to small fabric surface areas and/or a small number of garments, as well as non-manually operated, powered sprayers for conveniently treating the wrinkle control composition to large fabric surface areas and/or a large number of garments. The spray dispenser herein does not normally include those that will substantially foam the clear, aqueous wrinkle control composition. It has been found that the performance is increased by providing smaller particle droplets. Desirably, the Sauter mean particle diameter is from about 10 $\mu$m to about 120 $\mu$m, more preferably, from about 20 $\mu$m to about 100 $\mu$m. Dewrinkling benefits are improved by providing small particles (droplets), as discussed hereinbefore, especially when the surfactant is present.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the clear, aqueous de-wrinkle composition contained in the dispenser to be dispensed in the form of a spray of very fine, or finely divided, particles or droplets. The aerosol dispenser utilizes a pressurized sealed container from which the clear, aqueous de-wrinkle composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present hydrocarbon propellants are not preferred, because they can form complexes with the cyclodextrin molecules thereby reducing the availability of uncomplexed cyclodextrin molecules for odor absorption. Preferred propellants are compressed air, nitrogen, inert gases, carbon dioxide, etc. A more complete description of commercially available aerosol-spray dispensers appears in U.S. Pat. No. 3,436,772, Stebbins, issued Apr. 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of wrinkle control composition product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the wrinkle control composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

More preferably, the spray dispenser is a non-aerosol, manually activated, pump-spray dispenser. Said pump-spray dispenser comprises a container and a pump mechanism which securely screws or snaps onto the container. The container comprises a vessel for containing the aqueous wrinkle control composition to be dispensed.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel. A more complete disclosure of commercially available dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A preferred container is made of clear, e.g. polyethylene terephthalate. The trigger-spray dispenser does not incorporate a propellant gas into the odor-absorbing composition, and preferably it does not include those that will foam the wrinkle control composition. The trigger-spray dispenser herein is typically one which acts upon a discrete amount of the wrinkle control composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references are incorporated herein by reference.

A broad array of trigger sprayers or finger pump sprayers are suitable for use with the compositions of this invention. These are readily available from suppliers such as Calmar, Inc., City of Industry, California; CSI (Continental Sprayers, Inc.), St. Peters, Mo.; Berry Plastics Corp., Evansville, Ind., a distributor of Guala sprayers; or Seaquest Dispensing, Cary, Ill.

The preferred trigger sprayers are the blue inserted Guala® sprayer, available from Berry Plastics Corp., or the Calmar TS800-1A®, TS1300®, and TS-800-2®, available from Calmar Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

The article of manufacture herein can also comprise a non-manually operated spray dispenser. By "non-manually operated" it is meant that the spray dispenser can be manually activated, but the force required to dispense the wrinkle control composition is provided by another, non-manual means. Non-manually operated sprayers include, but are not limited to, powered sprayers, air aspirated sprayers, liquid aspirated sprayers, electrostatic sprayers, and nebulizer sprayers. The wrinkle control composition is placed into a spray dispenser in order to be distributed onto the fabric.

Powered sprayers include self contained powered pumps that pressurize the aqueous de-wrinkle composition and dispense it through a nozzle to produce a spray of liquid droplets. Powered sprayers are attached directly or remotely through the use of piping/tubing to a reservoir (such as a bottle) to hold the aqueous wrinkle control composition. Powered sprayers may include, but are not limited to, centrifugal or positive displacement designs. It is preferred that the powered sprayer be powered by a portable DC electrical current from either disposable batteries (such as commercially available alkaline batteries) or rechargeable battery units (such as commercially available nickel cadmium battery units). Powered sprayers may also be powered by standard AC power supply available in most buildings. The discharge nozzle design can be varied to create specific spray characteristics (such as spray diameter and particle size). It is also possible to have multiple spray nozzles for different spray characteristics. The nozzle may or may not contain an adjustable nozzle shroud that would allow the spray characteristics to be altered.

Nonlimiting examples of commercially available powered sprayers are disclosed in U.S. Pat. No. 4,865,255, Luvisotto, issued Sep. 12, 1989 which is incorporated herein by reference. Preferred powered sprayers are readily available from suppliers such as Solo, Newport News, Va. (e.g., Solo Spraystar™ rechargeable sprayer, listed as manual part #: US 460 395) and Multi-sprayer Systems, Minneapolis, Minn. (e.g., model: Spray 1).

Air aspirated sprayers include the classification of sprayers generically known as "air brushes". A stream of pressurized air draws up the aqueous wrinkle control composition and dispenses it through a nozzle to create a spray of liquid. The wrinkle control composition can be supplied via separate piping/tubing or more commonly is contained in a jar to which the aspirating sprayer is attached.

Nonlimiting examples of commercially available air aspirated sprayers appears in U.S. Pat. No. 1,536,352, Murray, issued Apr. 22, 1924 and U.S. Pat. No. 4,221,339, Yoshikawa, issues Sep. 9, 1980; all of said references are incorporated herein by reference. Air aspirated sprayers are readily available from suppliers such as The Badger Air-Brush Co., Franklin Park, Ill. (e.g., model #: 155) and Wilton Air Brush Equipment, Woodridge, Ill. (e.g., stock #: 415-4000, 415-4001, 415-4100).

Liquid aspirated sprayers are typical of the variety in widespread use to spray garden chemicals. The aqueous dewrinkling composition is drawn into a fluid stream by means of suction created by a Venturi effect. The high turbulence serves to mix the aqueous wrinkle control composition with the fluid stream (typically water) in order to provide a uniform mixture/concentration. It is possible with this method of delivery to dispense the aqueous concentrated wrinkle control composition of the present invention and then dilute it to a selected concentration with the delivery stream.

Liquid aspirated sprayers are readily available from suppliers such as Chapin Manufacturing Works, Batavia, N.Y. (e.g., model #: 6006).

Electrostatic sprayers impart energy to the aqueous dewrinkling composition via a high electrical potential. This energy serves to atomize and charge the aqueous wrinkle control composition, creating a spray of fine, charged particles. As the charged particles are carried away from the sprayer, their common charge causes them to repel one another. This has two effects before the spray reaches the target. First, it expands the total spray mist. This is especially important when spraying to fairly distant, large areas. The second effect is maintenance of original particle size. Because the particles repel one another, they resist collecting together into large, heavier particles like uncharged particles do. This lessens gravity's influence, and increases the charged particle reaching the target. As the mass of negatively charged particles approach the target, they push electrons inside the target inwardly, leaving all the exposed surfaces of the target with a temporary positive charge. The resulting attraction between the particles. and the target overrides the influences of gravity and inertia. As each particle deposits on the target, that spot on the target becomes neutralized and no longer attractive. Therefore, the next free particle is attracted to the spot immediately adjacent and the sequence continues until the entire surface of the target is covered. Hence, charged particles improve distribution and reduce drippage.

Nonlimiting examples of commercially available electrostatic sprayers appears in U.S. Pat. No. 5,222,664, Noakes, issued Jun. 29, 1993; U.S. Pat. No. 4,962,885, Coffee, issued Oct. 16, 1990; U.S. Pat. No. 2,695,002, Miller, issued November 1954; U.S. Pat. No. 5,405,090, Greene, issued Apr. 11, 1995; U.S. Pat. No. 4,752,034, Kuhn, issued Jun. 21, 1988; U.S. Pat. No. 2,989,241, Badger, issued June 1961; all of said patents are incorporated herein by reference. Electrostatic sprayers are readily available from suppliers such as Tae In Tech Co, South Korea and Spectrum, Houston, Tex.

Nebulizer sprayers impart energy to the aqueous dewrinkling composition via ultrasonic energy supplied via a transducer. This energy results in the aqueous wrinkle control composition to be atomized. Various types of nebulizers include, but are not limited to, heated, ultrasonic, gas, venturi, and refillable nebulizers.

Nonlimiting examples of commercially available nebulizer sprayers appears in U.S. Pat. No. 3,901,443, Mitsui, issued Aug. 26, 1975; U.S. Pat. No. 2,847,248, Schmitt, issued August 1958; U.S. Pat. No. 5,511,726, Greenspan, issued Apr. 30, 1996; all of said patents are incorporated herein by reference. Nebulizer sprayers are readily available from suppliers such as A&D Engineering, Inc., Milpitas, Calif. (e.g., model A&D Un-231 ultrasonic handy nebulizer) and Amici, Inc., Spring City, Pa. (model: swirler nebulizer).

The preferred article of manufacture herein comprises a non-manually operated sprayer, such as a battery-powered sprayer, containing the stable, aqueous compositions. More preferably the article of manufacture comprises a combination of a non-manually operated sprayer and a separate container of the stable, aqueous composition, to be added to the sprayer before use and/or to be separated for filling/refilling. The separate container can contain an usage composition, or a concentrated composition to be diluted before use, and/or to be used with a diluting sprayer, such as with a liquid aspirated sprayer, as described herein above.

Also, as described hereinbefore, the separate container should have structure that mates with the rest of the sprayer to ensure a solid fit without leakage, even after motion, impact, etc. and when handled by inexperienced consumers. The sprayer desirably can also have an attachment system that is safe and preferably designed to allow for the liquid container to be replaced by another container that is filled. E.g., the fluid reservoir can be replaced by a filled container. This can minimize problems with filling, including minimizing leakage, if the proper mating and sealing means are present on both the sprayer and the container. Desirably, the sprayer can contain a shroud to ensure proper alignment and/or to permit the use of thinner walls on the replacement container. This minimizes the amount of material to be recycled and/or discarded. The package sealing or mating system can be a threaded closure (sprayer) which replaces the existing closure on the filled and threaded container. A gasket is desirably added to provide additional seal security and minimize leakage. The gasket can be broken by action of the sprayer closure. These threaded sealing systems can be based on industry standards. However, it is highly desirable to use a threaded sealing system that has non-standard dimensions to ensure that the proper sprayer/bottle combination is always used. This helps prevent the use of fluids that are toxic, which could then be dispensed when the sprayer is used for its intended purpose.

An alternative sealing system can be based on one or more interlocking lugs and channels. Such systems are commonly referred to as "bayonet" systems. Such systems can be made in a variety of configurations, thus better ensuring that the proper replacement fluid is used. For convenience, the locking system can also be one that enables the provision of a "child-proof" cap on the refill bottle. This "lock-and-key" type of system thus provides highly desirable safety features. There are a variety of ways to design such lock and key sealing systems.

Care must be taken, however, to prevent the system from making the filling and sealing operation too difficult. If desired, the lock and key can be integral to the sealing mechanism. However, for the purpose of ensuring that the correct recharge or refill is used, the interlocking pieces can be separate from the sealing system. E.g., the shroud and the container could be designed for compatibility. In this way, the unique design of the container alone could provide the requisite assurance that the proper recharge/refill is used.

Examples of threaded closures and bayonet systems can be found in U.S. Pat. No. 4,781,311, Nov. 1, 1988 (Angular Positioned Trigger Sprayer with Selective Snap-Screw Container Connection, Clorox), U.S. Pat. No. 5,560,505, Oct. 1, 1996 (Container and Stopper Assembly Locked Together by Relative Rotation and Use Thereof, Cebal SA), and U.S. Pat. No. 5,725,132, Mar. 10, 1998 (Dispenser with Snap-Fit Container Connection, Centico International). All of said patents are incorporated herein by reference.

Bottle, Preferably with a Measuring Closure

The stable, aqueous compositions herein (especially concentrated compositions) can also be packaged in a bottle, especially a bottle that comprises a measuring closure. The measuring closure provides a convenient means to dispense the appropriate amount of the composition, especially when dispensing concentrated compositions into a wash and/or rinse solution containing fabrics to be treated in a typical laundry process. The bottle also preferably comprises a drain-back spout, which permits the composition to be dispensed more easily and with less mess. Non-limiting examples of suitable bottles are described in detail in U.S. Pat. No. 4,666,065 issued May 19, 1987 to Ohren; U.S. Pat. No. 4,696,416 issued Sep. 29, 1987 to Muckenfuhs et al.; and U.S. Pat. No. 4,981,239 issued Jan. 1, 1991 to Cappel et al.; all of which All percentages, ratios, and parts herein, in the Specification, Examples, and Claims are by weight and are the normal approximations, unless otherwise stated. All cited references are incorporated herein by reference, unless otherwise stated.

IV. EXAMPLES

The following are non-limiting examples of the stable, aqueous compositions of the present invention.

| Examples<br>Ingredients | I<br>Wt % | II<br>Wt % | III<br>Wt % | IV<br>Wt % | V<br>Wt % | VI<br>Wt % |
|---|---|---|---|---|---|---|
| Silwet L-77 | 0.2 | — | — | — | 0.15 | — |
| DC Q2-5211 | — | 0.2 | — | — | — | 0.15 |
| Silwet L-7280 | — | — | 0.2 | — | — | — |
| Silwet L-7608 | — | — | — | 0.2 | — | — |
| Sodium citrate dihydrate | 0.05 | 0.05 | 0.05 | 0.05 | 0.05 | 0.05 |
| Cyclodextrin | 1.0 | 1.0 | 1.0 | 1.0 | 1.0 | 1.0 |
| POE60 hydrogenated caster oil | 0.15 | 0.15 | 0.15 | 0.15 | 0.15 | 0.15 |
| Perfume | 0.12 | 0.120 | 0.120 | 0.120 | 0.120 | 0.120 |
| Cationic surfactant | 0.125[a] | 0.125[a] | 0.125[b] | 0.125[b] | 0.125[c] | 0.125[c] |
| Ethanol | 3.0 | 3.0 | 3.0 | 3.0 | 3.0 | 3.0 |
| Water | to balance | to balance | to balance | to balance | to balance | to balance |
| pH | 7.5 | 7.5 | 7.5 | 7.5 | 7.5 | 7.5 |

[a]Uniquat 2250 ® (Lonza)
[b]Bardac 2250 ® (Lonza)
[c]Dowicide ® (Dow)

| Examples<br>Ingredients | VII<br>Wt % | VIII<br>Wt % | IX<br>Wt % | X<br>Wt % | XI<br>Wt % | XII<br>Wt % |
|---|---|---|---|---|---|---|
| Silwet L-77 | 0.25 | — | 0.1 | 0.05 | 1.0 | 1.4 |
| DC Q2-5211 | — | 0.25 | 0.1 | 0.05 | — | — |
| Silwet L-7280 | — | — | — | 0.05 | — | — |
| Silwet L-7608 | — | — | — | 0.05 | — | — |
| Sodium citrate dihydrate | 0.05 | 0.05 | 0.05 | 0.05 | 0.25 | 0.35 |

-continued

| Examples<br>Ingredients | VII<br>Wt % | VIII<br>Wt % | IX<br>Wt % | X<br>Wt % | XI<br>Wt % | XII<br>Wt % |
|---|---|---|---|---|---|---|
| Cyclodextrin | 1.0 | 1.0 | 1.0 | 1.0 | 5 | 7 |
| POE60 hydrogenated caster oil | 0.15 | 0.15 | 0.15 | 0.15 | 0.75 | 1.05 |
| Perfume | 0.12 | 0.120 | 0.120 | 0.120 | 0.60 | 0.84 |
| Cationic surfactant | 0.125[d] | 0.125[d] | 0.125[a] | 0.125[a] | 0.625[a] | 0.875[b] |
| Ethanol | 3.0 | 3.0 | 3.0 | 3.0 | 15 | 21 |
| Water | to balance | to balance | to balance | to balance | to balance | to balance |
| pH | 7.5 | 7.5 | 7.5 | 7.5 | 8.5 | 8.5 |

[a]Uniquat 2250 ® (Lonza)
[b]Bardac 2250 ® (Lonza)
[c]Dowicide ® (Dow)
[d]Chlorhexidine

| Examples<br>Ingredients | XIII<br>Wt % | XIV<br>Wt % | XV<br>Wt % | XVI<br>Wt % |
|---|---|---|---|---|
| Silwet L-77 | 0.5 | — | — | — |
| DC Q2-5211 | — | — | — | — |
| Silwet L-7280 | — | — | — | — |
| Silwet L-7608 | — | 0.2 | 0.2 | — |
| Sylgard 309 | — | — | — | 0.2 |
| Sodium citrate dihydrate | 0.03 | 0.03 | 0.5 | 0.5 |
| Cyclodextrin | 0.75 | — | — | 1.0 |
| POE60 hydrogenated caster oil | 0.125 | 0.2 | 0.2 | 0.115 |
| Perfume | 0.14 | 0.16 | 0.015 | 0.1 |
| Cationic surfactant | 0.15[a] | 0.3[b] | 0.5[c] | 0.3[b] |
| Ethanol | 3.0 | 4.0 | 2.0 | 3.0 |
| Water | to balance | to balance | to balance | to balance |
| pH | 6.5 | 7.0 | 7.0 | 7.0 |

[a]Uniquat 2250 ® (Lonza)
[b]Bardac 2250 ® (Lonza)
[c]Dowicide ® (Dow)

What is claimed is:

1. A stable, aqueous composition for treating fabrics, said composition comprising:

(a) a polyalkyleneoxide polysiloxane having the formula:

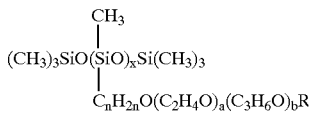

wherein x is from about 1 to about 8; n is from about 3 to about 4; a is from about 1 to about 15; b is from about 0 to about 14; a+b is from about 5 to about 15; and R is selected from the group consisting of hydrogen, an alkyl group having from about 1 to about 4 carbon atoms, and an acetyl group; and wherein said polyalkylene polysiloxane has a molecular weight of less than about 1,000;

(b) a buffering agent; wherein said buffering agent has at least one $pK_a$ value and/or $pK_b$ value of from about 4 to about 10; and (c) aqueous carrier;

wherein said composition has a pH of from about 4 to about 10.

2. The composition of claim 1, wherein said buffering agent has a pKa of from about 5 to about 9.5 and said composition has a pH of from about 5 to about 9.5.

3. The composition of claim 2, wherein said buffering agent has a pKa of from about 6 to about 9 and said composition has a pH of from about 6 to about 9.

4. The composition of claim 1, wherein said buffering agent is selected from the group consisting of acridine, phenylalanine, allothreonine, n-amylamine, aniline, n-allylaniline, 4-bromoaniline, 4-bromo-N,N-dimethylaniline, m-chloroaniline, p-chloroaniline, 3-chloro-N,N-dimethylaniline, 3,5-dibromoaniline, N,N-diethylaniline, N,N-dimethylaniline, N-ethylaniline, 4-fluoroaniline, N-methylaniline, 4-methylthioaniline, 3-sulfonic acid aniline, 4-sulfonic acid aniline, p-anisidine, arginine, asparagine, glycyl asparagine, DL-aspartic acid, aziridine, 2-aminoethylbenzene, benzidine, benzimidazole, 2-ethylbenzimidazole, 2-methylbenzimidazole, 2-phenylbenzimidazole, 2-aminobenzoic acid, 4-aminobenzoic acid, benzylamine, 2-aminobiphenyl, brucine, 1,4-diaminobutane, t-butylamine 4-aminobutyric acid, glycyl-2-amino-n-butyric acid, cacodylic acid, α-chlortriethylammonium-n-butyric acid, codeine, cyclohexylamine, cystine, n-decylamine, diethylamine, n-dodecaneamine, 1-ephedrine, 1-amino-3-methoxyethane, 1,2-bismethylaminoethane, 2-aminoethanol, ethylenediamine, ethylenediaminetetraacetic acid, 1-glutamic acid, α-monoethylglutamic acid, 1-glutamine, 1-glutathione, glycine, n-acetylglycine, dimethylglycine, glycylglycylglycine, leucylglycine, methylglycine, phenylglycine, N-n-propylglycine, tetraglycylglycine, glycylserine, dexadecaneamine, 1-aminoheptane, 2-aminoheptane, 2-aminohexanoic acid, DL-histidine, β-alanylhistidine, imidazol, 1-aminoindane, 2-aminoisobutyric acid, isoquinoline, 1-aminoisoquinoline, 7-hydroxyisoquinoline, 1-leucine, glycylleucine, methionine, methylamine, morphine, morpholine, 1-amino-6-hydroxynaphthalene, dimethylaminonaphthalene, α-naphthylamine, β-naphthylamine, n-methyl-α-naphthylamine, cis-neobornylamine, nicotine, n-nonylamine, octadecaneamine, octylamine, omithine, papaverine, 3-aminopentane, valeric acid, permidine, phenanthridine, 1,10-phenanthroline, 2-ethoxyaniline, 3-ethoxyaniline, 4-ethoxyaniline, α-picoline, β-picoline, γ-picoline, pilocarpine, piperazine, trans-2,5-dimethylpiperazine, 1-n-butylpiperidine, 1,2-dimethylpiperidine, 1-ethylpiperidine, 1-methylpiperidine, proline, hydroxyproline, 1-amino-2,2-dimethylpropane, 1,2-diaminopropane, 1,3-diaminopropane, 1,2,3-triaminopropane, 3-aminopropanoic acid, pteridine, 2-amino-4,6-dihydroxypteridine, 2-amino-4-hydroxypteridine, 6-chloropteridine, 6-hydroxy-4-methylpteridine, purine, 6-aminopurine, 2-dimethylaminopurine, 8-hydroxypurine, 2-methylpyrazine, 2-amino-4,6-dimethylpyrimidine, pyridine, 2-aldoximepyridine, 2-aminopyridine, 4-aminopyridine, 2-benzylpyridine, 2,5-diaminopyridine, 2,3-dimethylpyridine, 2,4-dimethylpyridine, 3,5-dimethylpyridine, 2-ethylpyridine, methyoxypyridine, 4-methylaminopyridine, 2,4,6-trimethylpyridine, 1,2-dimethylpyrrolidine, n-methylpyrrolidine, 5-hydroxyquinazoline, quinine, 3-quinolinol, 8-quinolinol, 8-hydroxy-5-sulfoquinoline, 6-methoxyquinoline, 2-methylquinoline, 4-methylquinoline, 5-methylquinoline, serine, strychnine, taurine, myristilamine, 2-aminothiazole, threonine, o-toluidine, m-toluidine, p-toluidine, 2,4,6-triamino-1,2,3-triazine, tridecaneamine, trimethylamine, tryptophan, tyrosine, tyrosineamide, valine, acetic acid, acetoacetic acid, acrylic acid, adipamic acid, adipic acid, d-alinine, allantoin acid, alloxanic acid, α-aminoacetic acid, o-aminobenzoic acid, p-aminobenzoic acid, m-aminobenzosulfonic acid, p-aminobenzosulfonic acid, anisic acid, o-β-anisylpropionic acid, m-β-propionic acid, p-β-propionic acid, ascorbic acid, DL-aspartic acid, barbituric acid, benzoic acid, m-bromobenzoic acid, n-butyric acid, iso-butyric acid, cacodylic acid, n-caproic acid, iso-caproic acid, m-chlorobenzoic acid, p-chlorobenzoic acid, β-chlorobutyric acid, γ-chlorobutyric acid, o-chlorocinnamic acid, m-chlorocinnamic acid, p-chlorocinnamic acid, o-chlorophenylacetic acid, m-chlorophenylacetic acid, p-chlorophenylacetic acid, β-(o-chlorophenyl)propionic acid, β-(m-chlorophenyl)propionic acid, β-(p-chlorophenyl)propionic acid, β-chloropropionic acid, cis-cinnamic acid, trans-cinnamic acid, citric acid, o-cresol, m-cresol, p-cresol, trans-crotonic acid, cyclohexane-1:1-dicarboxylic acid, cyclopropane-1:1-dicarboxylic acid, DL-cysteine, L-cysteine, deuteroacetic acid, 2,3-dichlorophenol, 3,4-dihydroxybenzoic acid, 3,5-dihydroxybenzoic acid, dimethylglycine, dimethylmalic acid, 2,4-dintirophenol, 3,6-dinitrophenol, diphenylacetic acid, ethylbenzoic acid, formic acid, trans-fumaric acid, gallic acid, glutaramic acid, glutaric acid, glycine, glycolic acid, heptanoic acid, hexahydrobenzoic acid, hexanoic acid, hippuric acid, histidine, hydroquinone, m-hydroxybenzoic acid, p-hyroxybenzoic acid, β-hyroxybutyric acid, γ-hydroxybutyric acid, β-hydroxypropionic acid, γ-hydroxyquinoline, iodoacetic acid, m-iodobenzoic acid, itaconic acid, lysine, maleic acid, malic acid, malonic acid, DL-mandelic acid, mesaconic acid, mesitylenic acid, methyl-o-aminobenzoic acid, methyl-m-aminobenzoic acid, methyl-p-aminobenzoic acid, o-methylcinnamic acid, m-methylcinnamic acid, p-methylcinnamic acid, β-methylglutaric acid, n-methylglycine, methylsuccinic acid, o-monochlorophenol, m-monochlorophenol, p-monochlorophenol, α-naphthoic acid, β-naphthoic acid, α-naphthol, β-naphthol, nitrobenzene, m-nitrobenzoic acid, p-nitrobenzoic acid, o-nitrophenol, m-nitrophenol, p-nitrophenol, o-nitrophenylacetic acid, m-nitrophenylacetic acid, p-nitrophenylacetic acid, o-β-nitrophenylpropionic acid, m-β-nitrophenylpropionic acid, p-β-nitrophenylpropionic acid, nonanic acid, octanoic acid, oxalic acid, phenol, phenylacetic acid, o-phenylbenzoic acid, γ-phenylbutyric acid, α-phenylpropionic acid, β-phenylpropionic acid, o-phthalic, m-phthalic, p-phthalic, pimelic acid, propionic acid, iso-propylbenzoic acid, 2-pyridinecarboxylic acid, 3-pyridinecarboxylic acid, 4-pyridinecarboxylic acid, pyrocatecchol, resorcinol, saccharin, suberic acid, succinic acid, α-tartaric acid, meso-tartaric acid, theobromine, terephthalic acid, thioacetic acid, thiophenecarboxylic acid, o-toluic acid, m-toluic acid, p-toluic acid, trichlorophenol, trimethylacetic acid, tryptophan, tyrosine, uric acid, n-valeric, iso-valeric, veronal acid, vinylacetic acid, xanthine, arsenic acid, arsenious acid, o-boric acid, carbonic acid, chromic acid, germanic acid, hyrocyanic acid, hydrofluoric acid, hydrogen sulfide, hypobromous acid, nitrous acid, o-phosphoric acid, phosphorous acid, pyrophosphoric acid, selenious acid, m-silicic acid, o-silicic acid, sulfurous acid, telluric acid, tellureous acid, tetraboric acid, and mixtures thereof.

5. The composition of claim 1, wherein said buffering agent is selected from the group consisting of 3chloropropanoic acid, citric acid, ethylenedinitriloletraacetic acid, alanine, aminobenzene, sulfanilic acid, 2-aminoberzoic acid, 2-aminophenol. ammonia, arginine, asparagine, aspartic acid, dimethyleneimine, benzene-1,2,3-tricarboxylic acid, benzoic acid, benzylamine, 2,2-bipyridine, butanoic acid, maleic acid, carbonic acid, dichloroacetic acid, diethylamine, catechol, resorcinol, d-tartaric acid, ethytenediamine, glutamic acid, glutamine, glycine, adipic acid, hydrogen hypophosphite, isoleucine, leucine, methionine, 3-nitrobenzoic acid, 4-nitrobenzoic acid, phthalic acid, iodoacetic acid, histidine, lysine, 4-methylaniline, o-cresol, 2-naphthoic acid, nitrilotriacetic acid, 2-nitrobenzoic acid, 4nitrophenol, 2,4-dinitrophenol, N-nitrosophenylhydroxylamine, nitrous acid, phosphoric acid, phenylalanine, piperdine, serine, hydrogen sulfite, threonine, tris(hydroxymethyl) aminomethane, tyrosine; alkali metal salts of said buffering agents; and mixtures thereof.

6. The composition of claim 1, wherein said buffering agent is an alkali metal salt of an organic acid and/or inorganic acid.

7. The composition of claim 1, wherein said composition is essentially free of material that would soil or stain fabric under usage conditions.

8. The composition of claim 1, wherein said composition further comprises an odor control agent.

9. The compsition of claim 8, wherein said odor control agent is cyclodextrin.

10. The composition of claim 1, wherein said composition further comprises a cationic surfactant.

11. The composition of claim 10, wherein said cationic surfactant is selected from the group consisting of quaternary compounds, biguanide compounds, and mixtures thereof.

12. The composition of claim 1, wherein said aqueous carrier comprises water and less than about 20% alcohol, wherein said alcohol is a monohydric or polyhydric alcohol.

13. The composition of claim 1, wherein said composition further comprises a perfume.

14. The composition of claim 1, wherein said composition further comprises a supplemental wrinkle control agent.

15. The composition of claim 14, wherein said supplemental wrinle control agent is selected from the group consisting of fiber lubricants, shape retention polymers, hydrophilic plasticizers, lithium salts, and mixtures thereof.

16. The composition of claim 1, wherein said composition further comprises an additional co-surfactant selected from the group consisting of nonionic surfactants, anionic surfactants, zwitterionic surfactants, fluorocarbon surfactants, and mixtures thereof.

17. The composition of claim 16, wherein said additional co-surfactant is a nonionic surfactant selected from the group consisting of alkyl ethoxylated surfactants, block copolymer surfactants, castor oil surfactants, sorbitan ester surfactants, polyethoxylated fatty alcohol surfactants, glycerol mono-fatty acid ester surfactants, polyethylene glycol fatty acid ester surfactants, and mixtures thereof.

18. The composition of claim 17, wherein said nonionic surfactant is a castor oil surfactant.

19. A stable, aqueous composition for treating fabrics, said composition comprising:

(a) a polyalkyleneoxide polysiloxane having the formula:

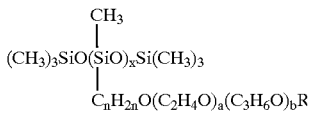

$$(CH_3)_3SiO(\overset{\overset{CH_3}{|}}{\underset{\underset{C_nH_{2n}O(C_2H_4O)_a(C_3H_6O)_bR}{|}}{Si}}O)_xSi(CH_3)_3$$

wherein x is from about 1 to about 8; n is from about 3 to about 4; a is from about 1 to about 15; b is from about 0 to about 14; a+b is from about 5 to about 15; and R is selected from the group consisting of hydrogen, an alkyl group having from about 1 to about 4 carbon atoms, and an acetyl group; and wherein said polyalkylene polysiloxane has a molecular weight of less than about 1,000;

(b) a cationic surfactant;

(c) a buffering agent; wherein said buffering agent has at least one $pK_a$ value and/or $pK_b$ value of from about 4 to about 10; and (d) aqueous carrier;

wherein said composition has a pH of from about 4 to about 10.

20. The composition of claim 19, wherein said polyalkyleneoxide polysiloxane has a molecular weight of from about 600 to about 700; and wherein x is from about 1 to about 3; n is about 3; a is from about 7 to about 8; b is 0; a+b is from about 7 to about 8; and R is an alkyl group having about 1 carbon atom.

21. A stable, aqueous composition for treating fabric, said composition comprising:

(a) a polyalkyleneoxide polysiloxane having the formula:

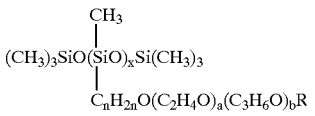

$$(CH_3)_3SiO(\overset{\overset{CH_3}{|}}{\underset{\underset{C_nH_{2n}O(C_2H_4O)_a(C_3H_6O)_bR}{|}}{Si}}O)_xSi(CH_3)_3$$

wherein x is from about 1 to about 8; n is from about 3 to about 4; a is from about 1 to about 15; b is from about 0 to about 14; a+b is from about 5 to about 15; and R is selected from the group consisting of hydrogen, an alkyl group having from about 1 to about 4 carbon atoms, and an acetyl group; and wherein said polyalkylene polysiloxane has a molecular weight of less than about 1,000;

(b) a cationic surfactant;

(c) a cyclodextrin;

(d) a cyclodextrin-compatible co-surfactant;

(e) a buffering agent; wherein said buffering agent has at least one $pK_a$ value and/or $pK_b$ value of from about 4 to about 10; and (f) aqueous carrier;

wherein said composition has a pH of from about 4 to about 10.

22. The composition of claim 21, wherein said polyalkyleneoxide polysiloxane has a molecular weight of from about 600 to about 700; and wherein x is from about 1 to about 3; n is about 3; a is from about 7 to about 8; b is 0; a+b is from about 7 to about 8; and R is an alkyl group having about 1 carbon atom.

23. A method of treating fabric comprising the step of contacting said fabric with a stable, aqueous composition according to claim 1.

24. A method of reducing malodor impression on fabric comprising the step of contacting said fabric with a stable, aqueous composition according to claim 1.

25. A method of reducing the appearance of wrinkles on fabric comprising the step of contacting said fabric with a stable, aqueous composition according to claim 1.

26. An article of manufacture for treating fabrics, said article comprising:

(a) a spray dispenser; and (b) a stable, aqueous composition contained in said spray dispenser, said composition comprising:

(i) a polyalkyleneoxide polysiloxane having the formula:

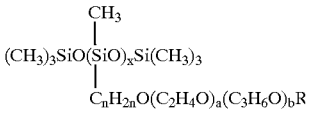

wherein x is from about 1 to about 8; n is from about 3 to about 4; a is from about 1 to about 15; b is from about 0 to about 14; a+b is from about 5 to about 15; and R is selected from the group consisting of hydrogen, an alkyl group having from about 1 to about 4 carbon atoms, and an acetyl group; and wherein said polyalkylene polysiloxane has a molecular weight of less than about 1,000;

(ii) a buttering agent; wherein said buffering agent has at least one $pK_a$ value and/or $pK_b$ value of from about 4 to about 10; and (iii) aqueous carrier;

wherein said composition has a pH of from about 4 to about 10.

27. The article of claim 26, wherein said spray dispenser is a manually operated spray dispenser.

28. The article of claim 26, wherein said spray dispenser is a non-manually operated spray dispenser.

29. The article of claim 26, wherein said polyalkyleneoxide polysiloxane has a molecular weight of from about 600 to about 700; and wherein x is from about 1 to about 3; n is about 3; a is from about 7 to about 8; b is 0; a+b is from about 7 to about 8; and R is an alkyl group having about 1 carbon atom.

* * * * *